US007884533B2

(12) United States Patent
Tsukamoto et al.

(10) Patent No.: US 7,884,533 B2
(45) Date of Patent: Feb. 8, 2011

(54) ELECTRON BEAM APPARATUS AND IMAGE DISPLAY APPARATUS USING THE SAME

(75) Inventors: Takeo Tsukamoto, Atsugi (JP); Takuto Moriguchi, Chigasaki (JP); Eiji Takeuchi, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 12/421,794

(22) Filed: Apr. 10, 2009

(65) Prior Publication Data

US 2009/0256464 A1 Oct. 15, 2009

(30) Foreign Application Priority Data

Apr. 10, 2008 (JP) ..... 2008-102009

(51) Int. Cl.

| | |
|---|---|
| ***H01J 1/304*** | (2006.01) |
| ***H01J 19/02*** | (2006.01) |
| ***H01J 1/30*** | (2006.01) |
| ***H01J 19/34*** | (2006.01) |
| ***H01J 19/38*** | (2006.01) |

(52) U.S. Cl. ..... 313/309; 313/495; 313/310

(58) Field of Classification Search ..... 313/495–497, 313/309–311

See application file for complete search history.

(56) References Cited

U.S. PATENT DOCUMENTS

| | | | | |
|---|---|---|---|---|
| 4,904,895 A | | 2/1990 | Tsukamoto et al. | 313/336 |
| 5,382,867 A | | 1/1995 | Yuji et al. | 313/309 |
| 5,457,355 A | * | 10/1995 | Fleming et al. | 313/336 |
| 5,614,795 A | * | 3/1997 | Kim | 313/336 |
| 5,679,960 A | | 10/1997 | Akama | 257/10 |
| 5,786,658 A | | 7/1998 | Tsukamoto et al. | 313/309 |
| 5,847,495 A | | 12/1998 | Yamanobe et al. | 313/310 |
| 5,859,493 A | * | 1/1999 | Kim | 313/309 |
| 5,986,389 A | | 11/1999 | Tsukamoto | 313/310 |
| 6,147,449 A | | 11/2000 | Iwasaki et al. | 313/495 |
| 6,171,162 B1 | | 1/2001 | Iwasaki et al. | 445/6 |
| 6,179,678 B1 | | 1/2001 | Kishi et al. | 445/24 |
| 6,184,610 B1 | | 2/2001 | Shibata et al. | 313/309 |

(Continued)

FOREIGN PATENT DOCUMENTS

EP 0 535 953 A2 4/1993

(Continued)

OTHER PUBLICATIONS

European Search Report issued in the counterpart application No. 09156252.0 dated Jun. 1, 2010—8 pages.

*Primary Examiner*—Mariceli Santiago
(74) *Attorney, Agent, or Firm*—Fitzpatrick, Cella, Harper & Scinto

(57) ABSTRACT

The present invention provides an electron beam apparatus provided with an electron-emitting device which has a simple structure, shows high electron-emitting efficiency and stably works. This electron beam apparatus has an insulating member and a gate formed on a substrate, a recess portion formed in the insulating member, a protruding portion that protrudes from an edge of the recess portion toward the gate and is provided on an end part of a cathode opposing to the gate, which is arranged on the side face of the insulating member; and makes an electric field converge on an end part in the width direction of the protruding portion to make an electron emitted therefrom.

8 Claims, 23 Drawing Sheets

U.S. PATENT DOCUMENTS

| | | | | |
|---|---|---|---|---|
| 6,231,413 | B1 | 5/2001 | Tsukamoto | 445/24 |
| 6,246,168 | B1 | 6/2001 | Kishi et al. | 313/495 |
| 6,288,494 | B1 | 9/2001 | Tsukamoto et al. | 315/169.1 |
| 6,384,542 | B2 | 5/2002 | Tsukamoto | 315/169.3 |
| 6,435,928 | B1 | 8/2002 | Tsukamoto | 445/24 |
| 6,472,814 | B1 | 10/2002 | Yamanobe et al. | 313/495 |
| 6,515,640 | B2 | 2/2003 | Tsukamoto et al. | 345/75.2 |
| 6,608,437 | B1 | 8/2003 | Kishi et al. | 313/495 |
| 6,626,719 | B2 | 9/2003 | Ono et al. | 445/24 |
| 6,843,696 | B2 | 1/2005 | Kitamura et al. | 445/24 |
| 6,848,962 | B2 | 2/2005 | Kitamura et al. | 445/24 |
| 6,858,990 | B2 | 2/2005 | Tsukamoto | 315/169.1 |
| 6,900,581 | B2 | 5/2005 | Kyogaku et al. | 313/310 |
| 6,948,995 | B2 | 9/2005 | Ishikura et al. | 445/51 |
| 6,992,428 | B2 | 1/2006 | Kyogaku et al. | 313/310 |
| 7,012,362 | B2 | 3/2006 | Kawate et al. | 313/495 |
| 7,034,444 | B2 | 4/2006 | Tsukamoto | 313/309 |
| 7,057,336 | B2 | 6/2006 | Kishi et al. | 313/495 |
| 7,064,475 | B2 | 6/2006 | Kuroda et al. | 313/311 |
| 7,067,336 | B1 | 6/2006 | Kyogaku et al. | 438/20 |
| 7,074,105 | B2 | 7/2006 | Kawate et al. | 445/51 |
| 7,074,380 | B2 | 7/2006 | Iwaki et al. | 423/447.3 |
| 7,094,123 | B2 | 8/2006 | Oyama et al. | 445/50 |
| 7,131,886 | B2 | 11/2006 | Kitamura et al. | 445/51 |
| 7,147,533 | B2 | 12/2006 | Kawate et al. | 445/49 |
| 7,186,160 | B2 | 3/2007 | Tsukamoto | 445/50 |
| 7,198,966 | B2 | 4/2007 | Kitamura et al. | 438/20 |
| 7,227,311 | B2 | 6/2007 | Tsukamoto | 315/169.3 |
| 7,234,985 | B2 | 6/2007 | Kishi et al. | 445/24 |
| 7,258,590 | B2 | 8/2007 | Oyama et al. | 445/50 |
| 7,271,529 | B2 | 9/2007 | Takeda et al. | 313/311 |
| 7,312,561 | B2 | 12/2007 | Moriguchi et al. | 313/310 |
| 7,399,215 | B2 | 7/2008 | Tsukamoto et al. | 445/51 |
| 7,419,416 | B2 | 9/2008 | Tsukamoto | 445/24 |
| 7,432,883 | B2 | 10/2008 | Oyama et al. | 345/75.2 |
| 7,442,404 | B2 | 10/2008 | Kuroda et al. | 427/74 |
| 7,459,844 | B2 | 12/2008 | Tsukamoto | 313/495 |
| 7,528,538 | B2 | 5/2009 | Kitamura et al. | 313/495 |
| 7,572,164 | B2 | 8/2009 | Takeda et al. | 445/46 |
| 7,582,001 | B2 | 9/2009 | Kitamura et al. | 445/50 |
| 7,583,015 | B2 | 9/2009 | Nukanobu et al. | 313/309 |
| 2001/0019247 | A1 | 9/2001 | Tsukamoto | |
| 2003/0124944 | A1 | 7/2003 | Kyogaku et al. | 445/6 |
| 2004/0174110 | A1 | 9/2004 | Ito et al. | 313/310 |
| 2005/0287689 | A1 | 12/2005 | Iwaki et al. | 438/22 |
| 2006/0228478 | A1 | 10/2006 | Iwaki et al. | 427/249.1 |
| 2006/0238104 | A1* | 10/2006 | Lin et al. | 313/495 |
| 2007/0141943 | A1 | 6/2007 | Kawate et al. | 445/50 |
| 2007/0188067 | A1 | 8/2007 | Tsukamoto et al. | 313/309 |
| 2008/0045112 | A1 | 2/2008 | Kishi et al. | 445/24 |
| 2008/0106181 | A1 | 5/2008 | Kawate et al. | 313/495 |
| 2008/0122336 | A1 | 5/2008 | Nukanobu et al. | 313/310 |
| 2009/0180946 | A1 | 7/2009 | Kitamura | 423/447.3 |
| 2009/0237570 | A1 | 9/2009 | Moriguchi et al. | 348/725 |
| 2009/0244398 | A1 | 10/2009 | Nukanobu et al. | 348/725 |
| 2009/0256457 | A1 | 10/2009 | Tsukamoto et al. | 313/6 |
| 2010/0060141 | A1 | 3/2010 | Kubota et al. | 313/496 |

FOREIGN PATENT DOCUMENTS

| | | | |
|---|---|---|---|
| EP | 0 665 571 | A1 | 8/1995 |
| EP | 1 324 366 | A2 | 7/2003 |
| EP | 1 347 487 | A2 | 9/2003 |
| JP | 63-274047 | | 11/1988 |
| JP | 2000-251629 | A | 9/2000 |
| JP | 2000-251643 | | 9/2000 |
| JP | 2001-167693 | | 6/2001 |
| JP | 2001-229809 | | 8/2001 |

* cited by examiner

FIG. 12C-A
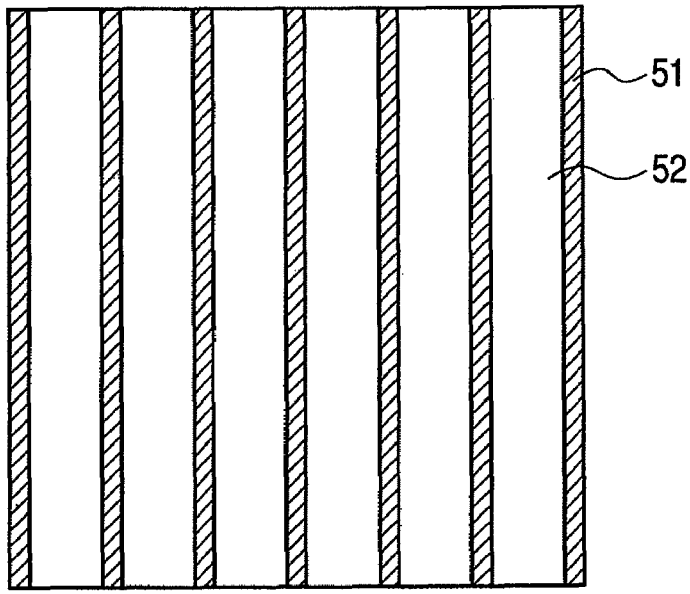
FIG. 12C-B
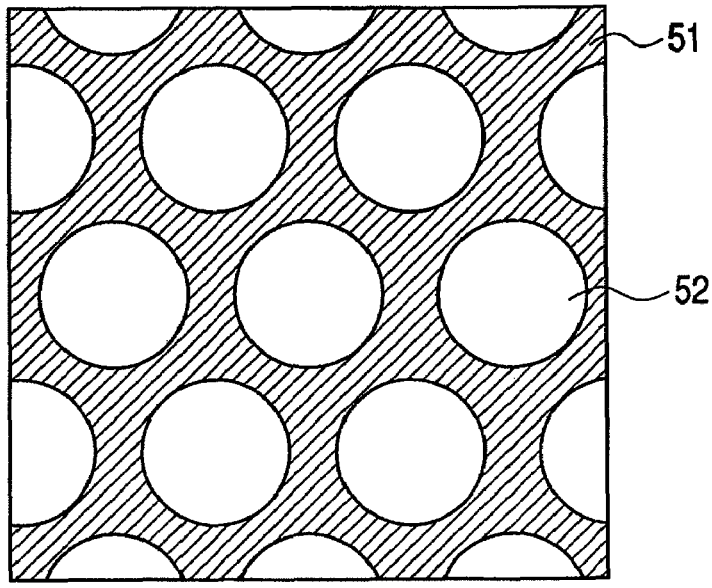

FIG. 14A-A
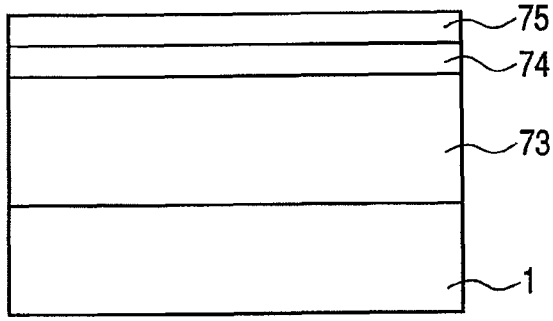
FIG. 14A-B
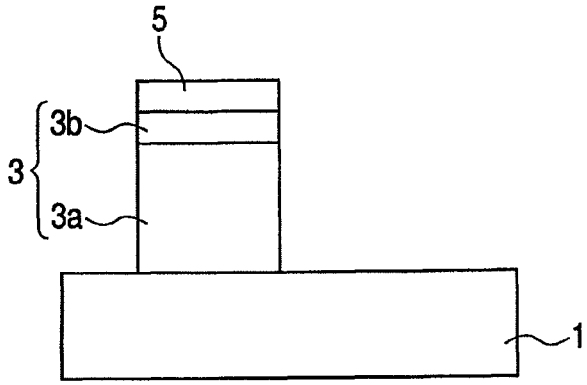
FIG. 14A-C
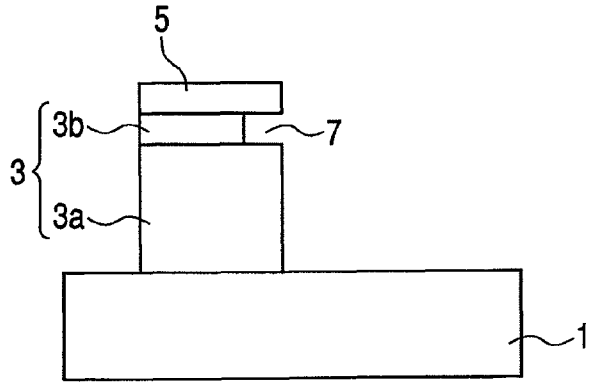

FIG. 14B-D
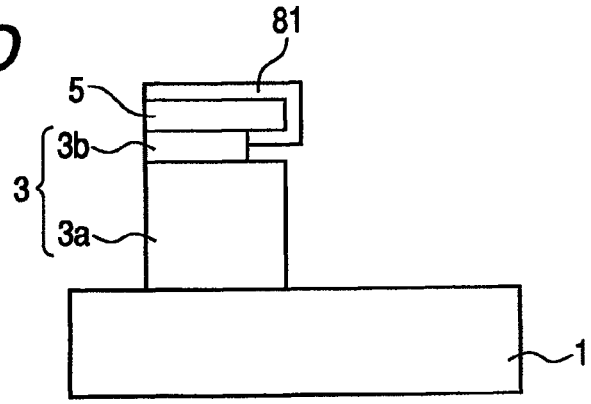
FIG. 14B-E
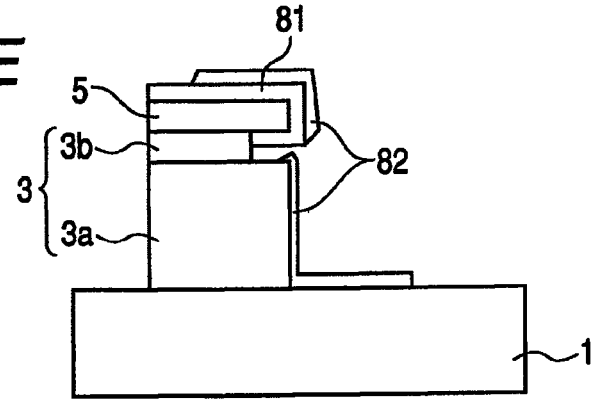
FIG. 14B-F
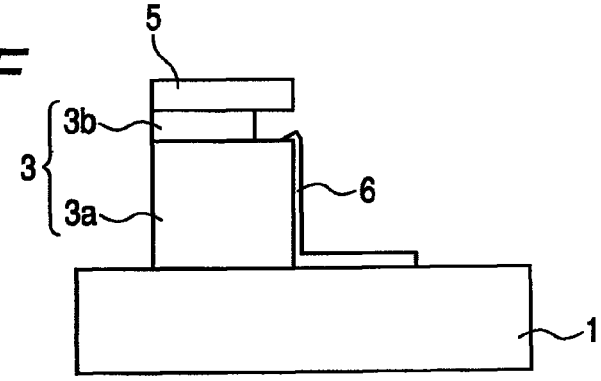

ELECTRON BEAM APPARATUS AND IMAGE DISPLAY APPARATUS USING THE SAME

BACKGROUND OF THE INVENTION

1. Field of the Invention

The present invention relates to an electron beam apparatus which is used for a flat panel display and has an electron-emitting device that emits an electron provided therein.

2. Description of the Related Art

Conventionally, there is an electron-emitting device which makes a large number of electrons to be emitted from a cathode, collide against a facing gate and be scattered therein, and then takes out the electron. A surface conduction type electron-emitting device and a stacked type electron-emitting device are known as a device which emits an electron in such a form, and Japanese Patent Application Laid-Open No. 2000-251643 discloses a high-efficiency electron-emitting device in which a gap of an electron-emitting portion is 5 nm or less. In addition, Japanese Patent Application Laid-Open No. 2001-229809 discloses a stacked type electron-emitting device, in which conditions of enabling electron emission with high efficiency are given by functions of the thickness of a gate material, driving voltage and the thickness of an insulating layer. Furthermore, Japanese Patent Application Laid-Open No. 2001-167693 discloses a stacked type electron-emitting device having a structure in which a recess portion is provided in an insulating layer in the vicinity of the electron-emitting portion.

Japanese Patent Application Laid-Open No. 2000-251643 discloses a device which makes a plurality of electron-emitting points exist in the formed gap, and thereby can provide an electron-emitting device which inhibits electric discharge in an electron-emitting portion, and can stably work for a long period of time. However, the above electron-emitting devices do not solve a problem sufficiently that an amount of electron to be emitted from each of points of the electron-emitting points increases and decreases along with a driving period of time of driving a device, even though the technologies could inhibit the electric discharge in the electron-emitting portion. In addition, the above electron-emitting devices showed a phenomenon of increasing and decreasing the number of the electron-emitting points existing in the gap along with the driving period of time of the electron-emitting device.

The same phenomenon as the above described phenomenon has been found also in the device disclosed in Japanese Patent Application Laid-Open No. 2001-229809, and a stable electron-emitting device has been desired.

Furthermore, the device disclosed in Japanese Patent Application Laid-Open No. 2001-167693 shows an excellent electron-emitting efficiency, but its characteristics have been required to be further enhanced.

SUMMARY OF THE INVENTION

The present invention has been designed at solving the above described problems of a conventional technology, and is directed at providing an electron beam apparatus having an electron-emitting device provided therein, which has a simple structure, shows high electron-emitting efficiency and stably works.

A first aspect of the present invention is an electron beam apparatus comprising: an insulating member having a recess portion on a surface thereof; a gate disposed on the surface of the insulating member; a cathode disposed on the surface of the insulating member, and having a protruding portion protruding from an edge of the recess portion toward the gate in opposition to the gate; and an anode disposed in opposition to the protruding portion so that the gate is disposed between the anode and the protruding portion, wherein a length of the protruding portion in a direction along the edge of the recess portion is shorter than a length of a portion of the gate opposing the protruding portion in the direction along the edge of the recess portion.

The electron beam apparatus according to the present invention can include the aspects in which a plurality of cathodes are disposed corresponding to the gate; the gate has a humped portion in opposition to the protruding portion, and the humped portion is shorter, in the direction along the edge of the recess portion, than the protruding portion; and the gate is covered with an insulating layer at a portion opposing to the recess.

A second aspect of an electron beam apparatus according to the present invention is an image display apparatus having an electron beam apparatus according to the present invention, and a light emitting member disposed on the anode.

According to the present invention, it is possible to selectively form a portion (strong portion) which has an increased electric-field strength in an electron-emitting device, and as a result, it is possible to easily control the position of electron-emitting points in a preferred embodiment.

The electron beam apparatus also can prevent emitted electrons from forming a leak current after having collided against the surface of the gate by covering the surface of the gate to be exposed to a recess portion of an insulating member with an insulating layer, and further can enhance its electron-emitting efficiency.

Furthermore, when having a plurality of cathodes with respect to the gate, the electron beam apparatus according to the present invention can control a shape of an electron beam to be emitted toward an anode, and provides a further stable electron-emitting action.

Still furthermore, the electron beam apparatus can make an emitted electron selectively collide against the humped portion, by providing the humped portion shorter than a width of the protruding portion of the cathode on the gate, and simultaneously can make a colliding portion of the emitted electron centralized on a side face of the humped portion. As a result, the electron after having collided against the side face flies to the anode without further colliding against other parts, so that the electron-emitting efficiency is further enhanced.

Therefore, the present invention realizes an electron beam apparatus provided with an electron-emitting device which has high electron-emitting efficiency and has a stable emitting action.

Further features of the present invention will become apparent from the following description of exemplary embodiments with reference to the attached drawings.

BRIEF DESCRIPTION OF THE DRAWINGS

FIGS. 12C-A and 12C-B are schematic plan views illustrating a configuration example of a fluorescent film which is used in a display panel in FIG. 12B.

FIGS. 14A-A, 14A-B and 14A-C are schematic sectional views illustrating a process of manufacturing an electron-emitting device according to the present invention.

FIGS. 14B-D, 14B-E and 14B-F are schematic sectional views illustrating a process of manufacturing an electron-emitting device according to the present invention.

DESCRIPTION OF THE EMBODIMENTS

Exemplary embodiments according to the present invention will now be illustratively described in detail below with reference to the drawings. However, a dimension, a material, a shape, a relative arrangement and the like of components which are described in this embodiment do not limit the scope of this invention only into those, unless otherwise specified.

The present invention was extensively investigated so that, it is possible to selectively form a portion (strong portion) which has an increased electric-field strength in an electron-emitting device, and as a result, in a preferred embodiment, an electron-emitting portion can control a position of an electron-emitting point with a simple structure and can stably work.

Firstly, a structure of an electron-emitting device which can stably emit an electron according to the present invention will now be described below with reference to exemplary embodiments.

An electron beam apparatus according to the present invention includes an electron-emitting device which emits an electron, and an anode which an electron emitted from the electron-emitting device reaches.

An electron-emitting device according to the present invention includes an insulating member having a recess portion on a surface thereof, and a gate and a cathode disposed on the surface of the insulating member. The cathode has a protruding portion protruding from an edge of the recess portion toward the gate, and the protruding portion is positioned so as to oppose to the gate. Furthermore, a length of the protruding portion in a direction along the edge of the recess portion is formed so as to be shorter than a length of a portion of the gate opposing to the protruding portion in the direction along the edge of the recess portion. The anode is disposed in opposition to the protruding portion so that the gate is disposed between the anode and the protruding portion.

Figure 1A:
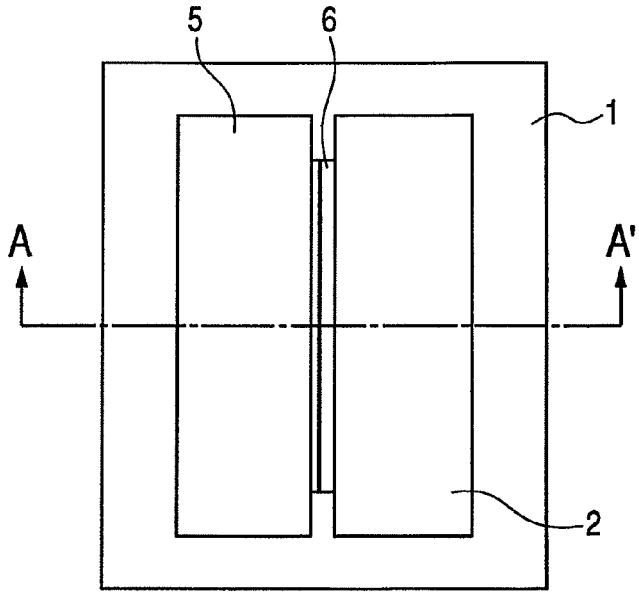
FIGS. 1A, 1B and 1C are views which schematically illustrate a structure of an electron-emitting device in an exemplary embodiment of an electron beam apparatus according to the present invention.
Figure 1B:
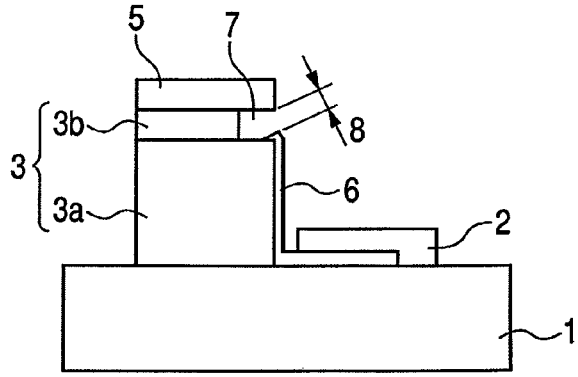
Figure 1C:
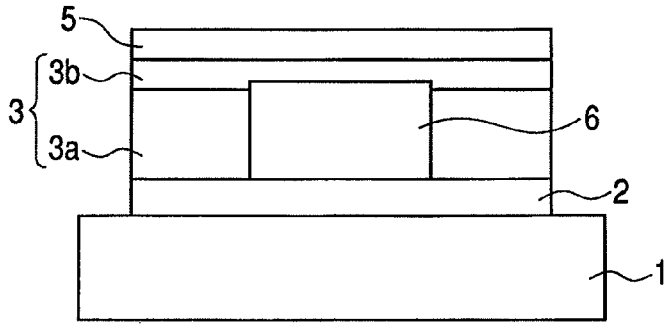

FIG. 1A is a schematic plan view which schematically illustrates a structure of an electron-emitting device in an exemplary embodiment according to the present invention. FIG. 1B is a schematic sectional view which is taken along the line A-A' of FIG. 1A. FIG. 1C is a side view of a device, which is viewed from a right side of a page space in FIG. 1A.

In FIGS. 1A to 1C, a substrate 1, an electrode 2 and an insulating member 3 which is made of a stacked body of insulating layers 3*a* and 3*b* are shown. A gate 5 and a cathode 6 which is electrically connected to the electrode 2 are shown. There is a recess portion 7 in the insulating member 3, which is formed by denting only a side face of the insulating layer 3*b* to an inner side than the insulating layer 3*a*, in the present example. A gap 8 (the shortest distance between head of cathode 6 and bottom face of gate 5), in which an electric field necessary for an electron emission is formed, is shown.

In an electron-emitting device according to the present invention, the gate 5 is formed on the surface of the insulating member 3 (upper face in this example), as is illustrated in FIGS. 1A to 1C. On the other hand, the cathode 6 is formed on the surface of the insulating member 3 (side face in this example), and has a protruding portion protruding from an edge of the recess portion 7 toward the gate 5 in a position opposite to the gate 5 while sandwiching the recess portion 7. Therefore, the cathode 6 opposes to the gate 5 through the gap 8 in the protruding portion. In the present invention, the cathode 6 is specified to be a lower potential than that of the gate 5. Though being not shown in FIGS. 1A to 1C, in a position opposing to the cathode 6 through the gate 5 (interposed), there is an anode which has been specified to have a higher potential than the gate 5 and the cathode 6 (20 in FIG. 2).

Figure 2:
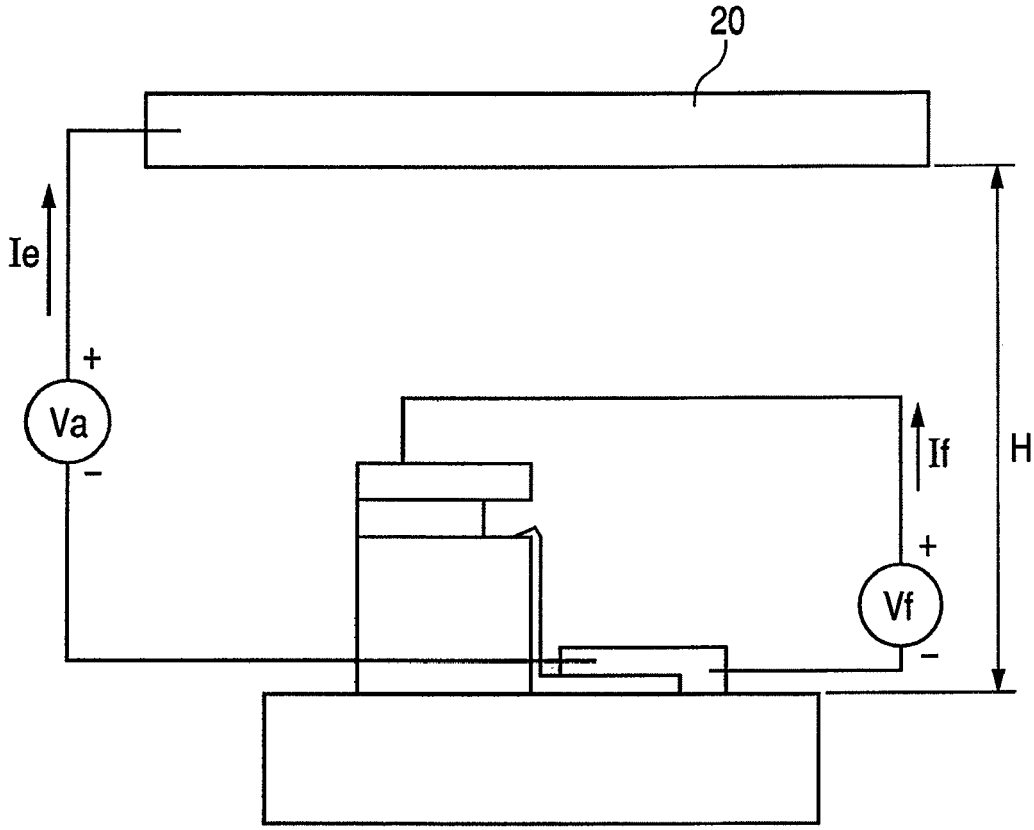
FIG. 2 is a view which schematically illustrates a system for measuring an electron-emitting device in an electron-emitting device according to the present invention.

FIG. 2 illustrates an arrangement of a power source to be supplied when measuring electron-emitting characteristics of a device according to the present invention. In an electron beam apparatus according to the present invention, an anode 20 is disposed in opposition to a protruding portion of a cathode 6 so that the gate 5 is disposed between the anode 20 and the protruding portion, as is illustrated in FIG. 2. In this example, an insulating member 3 is arranged on a substrate 1, so that the anode 20 is arranged so as to oppose to the substrate 1, in a side having the insulating member 3 arranged thereon of the substrate 1.

In FIG. 2, Vf represents a voltage which is applied in between the gate 5 and the cathode 6 in the device, If represents a device current which flows in the device at this time, Va represents a voltage which is applied in between the cathode 6 and the anode 20, and Ie represents an electron-emitting current.

Here, an electron-emitting efficiency $\eta$ is generally given by efficiency $\eta$=Ie/(If+Ie), by using the current If which is detected when a voltage is applied to the device and the current Ie which is taken out into the vacuum.

Figure 3:
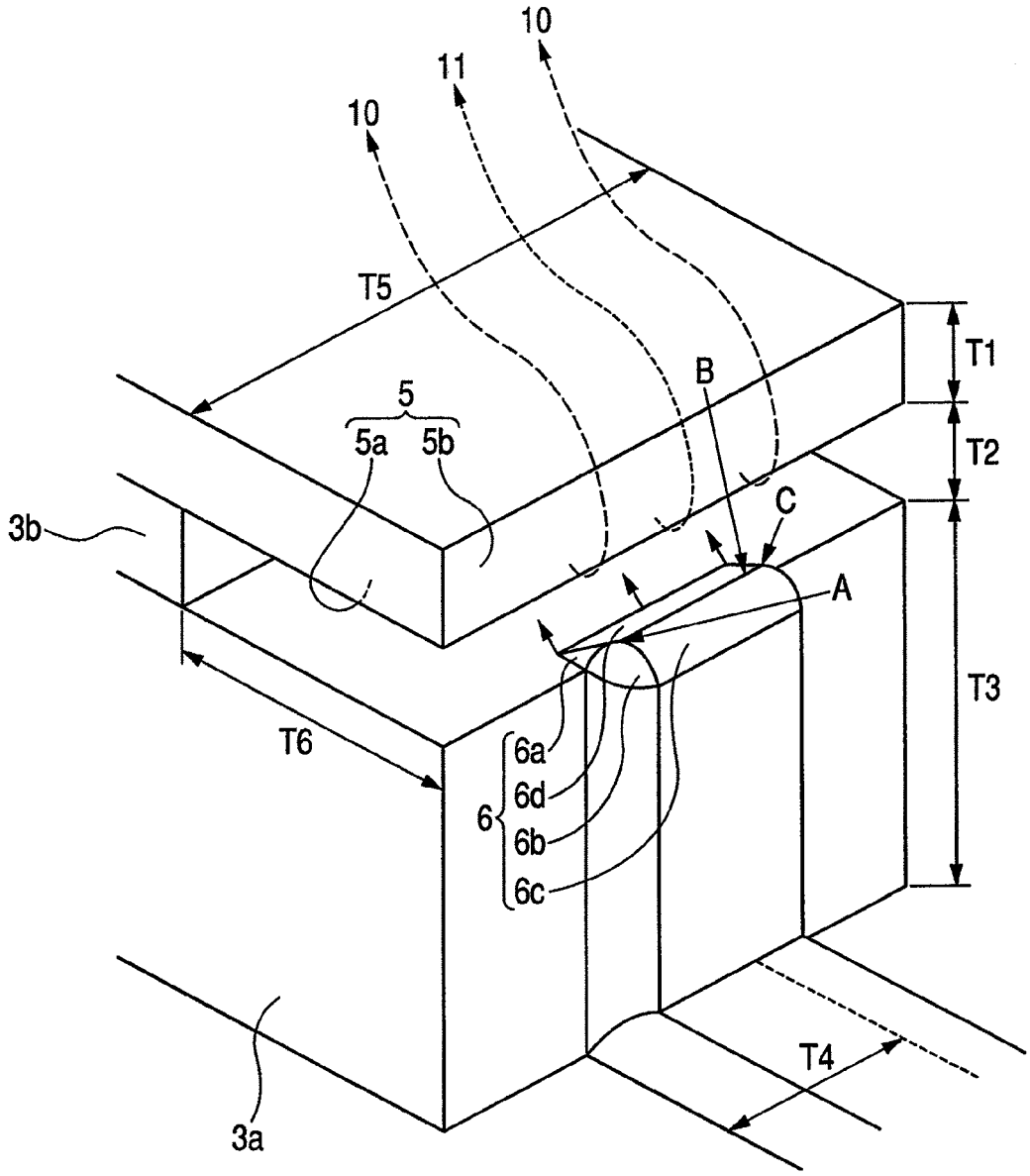
FIG. 3 is a partial enlarged schematic view of an electron-emitting device in FIGS. 1A to 1C.
Figure 5A:
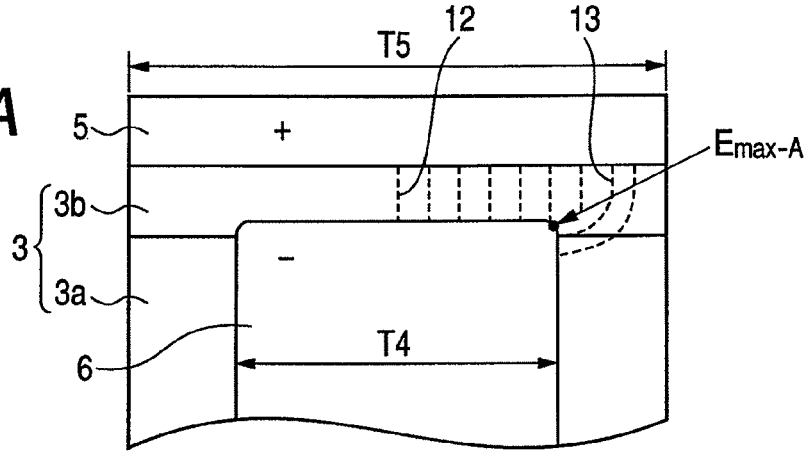
FIGS. 5A, 5B and 5C are views illustrating a state of the convergence of an electric field occurring when voltage is applied to an electron-emitting device according to the present invention.
Figure 5B:
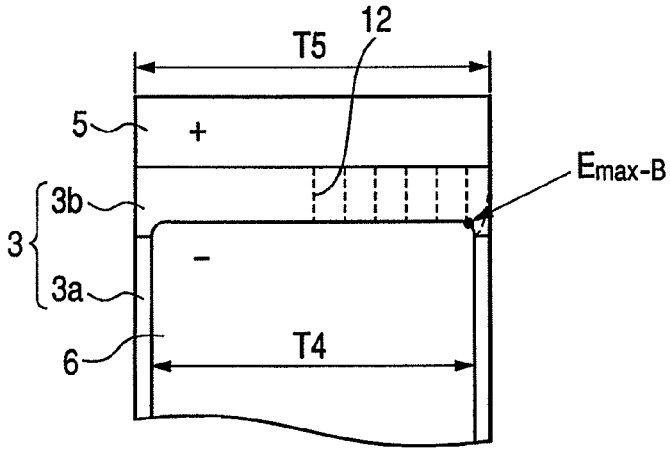

FIG. 3 illustrates an enlarged schematic view of an opposing site of a gate 5 to a cathode 6 in an electron-emitting device in FIGS. 1A to 1C. In FIGS. 3, 5*a* and 5*b* represent bottom faces and side faces of the gate 5 respectively, and 6*a*, 6*b*, 6*c* and 6*d* represent each of faces of the protruding portion of the cathode 6, which are exploded into surface elements.

A state of the convergence of an electric field occurring when voltage Vf has been applied to a device according to the present invention as is illustrated in FIG. 2 will now be described in further detail below with reference to FIGS. 4A and 4B and FIGS. 5A to 5C.

FIGS. 4A and 4B and FIGS. 5A to 5C are enlarged views of a recess portion 7 in a cross-section which is taken along the line A-A' of FIG. 1A, and broken lines 12 and 13 schematically illustrate electric flux lines to be formed in the recess portion 7. The strength and weakness of the electric field are determined by the density of electric flux lines 12 and 13, and the higher is the density of the electric flux lines, the stronger is the electric field. In FIG. 4A to FIG. 6 including FIG. 6 which will be described later, only electric flux lines to be formed in a two-dimensional vacuum region are shown for convenience, but actually the electric flux lines are three-dimensionally formed and spread in an insulating member 3 as well.

Figure 4A:
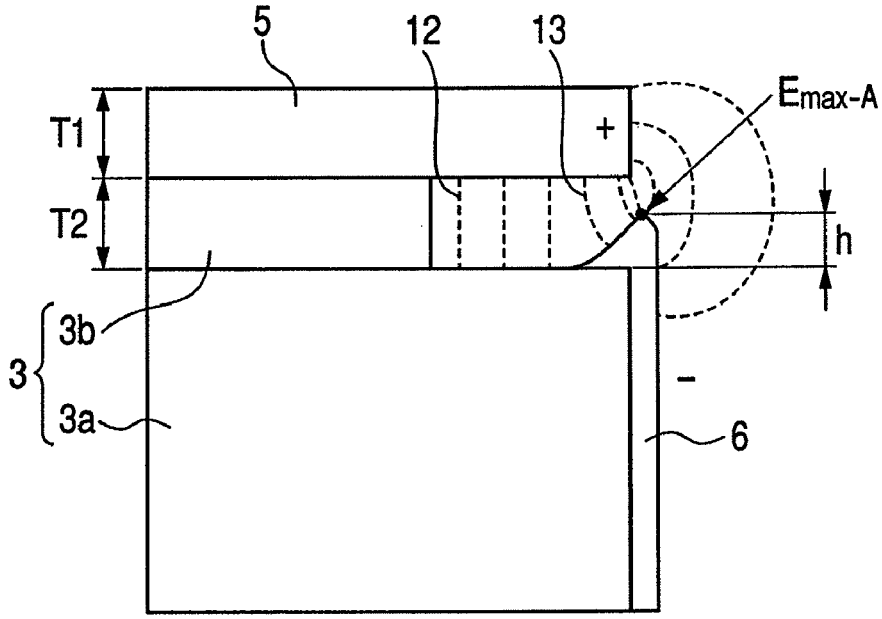
FIGS. 4A and 4B are views illustrating a state of the convergence of an electric field occurring when voltage is applied to an electron-emitting device according to the present invention.
Figure 4B:
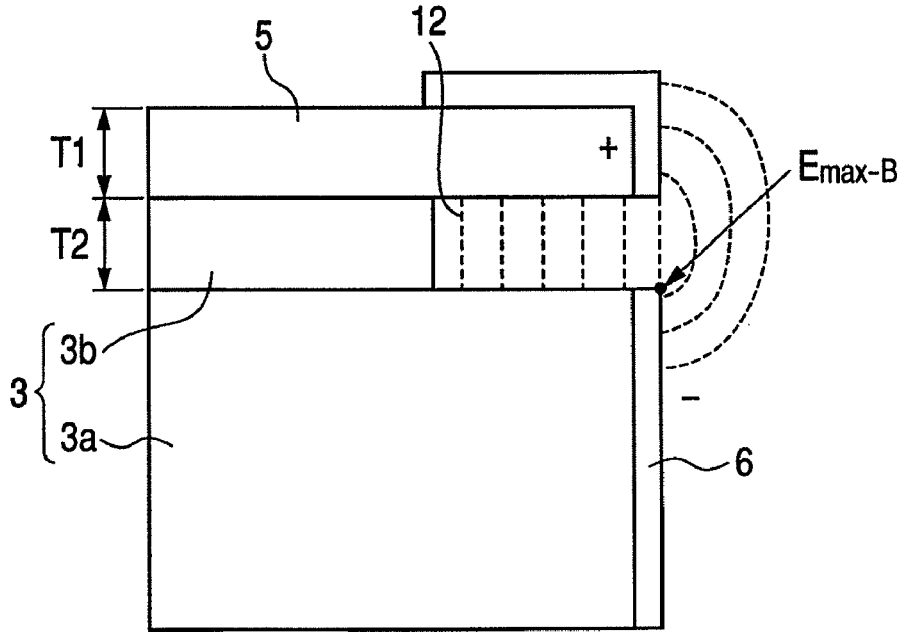

FIG. 4A illustrates a state of an electric flux line to be formed when a protruding portion of a cathode 6 exists in the recess portion 7, and FIG. 4B illustrates an electric flux line formed when the protruding portion of the cathode 6 does not exist in the recess portion 7, as is shown in a conventional example.

The electric flux line 13 curves towards a protruding portion which has been formed in the recess portion 7 as is illustrated in FIG. 4A, and thereby the density of the electric flux line increases on the head of the protruding portion, so that the electric field on the head of the protruding portion becomes strongest ($E_{max\text{-}A}$) among electric fields formed in the recess portion 7. On the other hand, in FIG. 4B, a linear electric flux line 12 is formed in the recess portion 7.

Moreover, the protruding portion has a shape of protruding toward the inner part of the recess portion 7 from the edge of the recess portion 7, as is illustrated in (h) of FIG. 4A. Therefore, even when employed insulating layers 3*b* have the same thickness T2 in FIG. 4A and FIG. 4B (in other words, even when recess portions 7 have the same height), distances between the head of the cathode 6 and the gate 5 are different from each other due to the existence of the height (h) of the protruding portion, so that $E_{max\text{-}A}$ becomes larger than $E_{max\text{-}B}$.

Figure 5C:
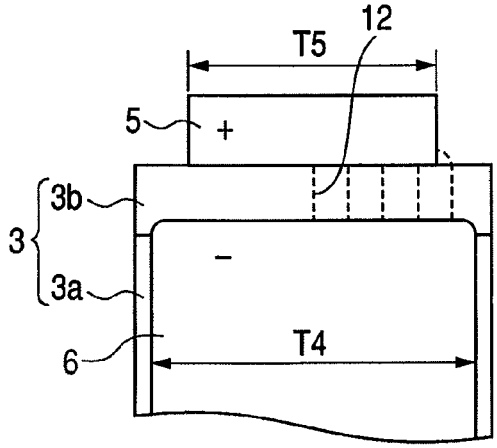

Next, FIGS. 5A to 5C illustrate a relationship between a magnitude of a T4 which is a length of the protruding portion of the cathode 6 in a direction along the edge of the recess portion 7 (hereinafter referred to as width) relative to a magnitude of a T5 which is a length of a portion of the gate 5 opposing the protruding portion in the direction along the edge of the recess portion (hereinafter referred to as width) is smaller or larger, and an electric flux line to be formed. Incidentally, the electric flux line is formed symmetrically in both sides of the center in a width direction of the cathode 6, so that the electric flux line only in one side is shown in FIGS. 5A to 5C for convenience.

FIG. 5A illustrates an electric flux line formed when T4 is smaller than T5. The electric flux line curves toward the end part of the width direction of the protruding portion of the cathode 6, and thereby, the density of the electric flux line 13 increases on the end part, so that the electric field on the end part becomes strongest ($E_{max\text{-}A}$) among electric fields.

FIG. 5B illustrates an electric flux line to be formed when T4 has approximately the same length as T5. In this case, the electric flux line 13 curves toward an end part in the width direction of the protruding portion of the cathode 6, so that an electric field converges on the end part ($E_{max\text{-}B}$). However, the density of the electric flux line 13 extending from the gate 5 is lower than that in FIG. 5A, so that $E_{max\text{-}A}$ becomes larger than $E_{max\text{-}B}$.

FIG. 5C illustrates an electric flux line to be formed when T4 is larger than T5. In this case, the electric flux line does not converge on the end part in the width direction of the protruding portion in the cathode 6, so that a portion having the maximum electric field is not formed on the end part in the width direction.

An electron emission in a device due to the convergence of the electric field which was described above according to the present invention will now be sequentially described below with reference to FIG. 3.

Here, T1 represents the thickness of a gate 5, T2 represents the thickness of an insulating layer 3*b* (=height of recess portion 7), and T3 represents the thickness of an insulating layer 3*a* (=height from surface of substrate 1 to edge of recess portion 7).

When a voltage Vf is applied to a device in FIG. 3, an electric field is formed in between a cathode 6 and a gate 5 in FIG. 3. At this time, when an end part in a recess portion 7 side of the cathode 6 is an approximately wedge shape and has a protruding portion formed so as to protrude closer to the recess portion 7 side than the edge of the recess portion 7, the point of the maximum electric field is formed in the vicinity of a point at which each of surface elements 6*a* to 6*d* in the cathode 6 crosses, that is to say, a point A or a point C. Following the point A and the point C, the electric field in the vicinity of a line B becomes high, on which the surface elements 6*c* and 6*d* cross.

The strength and weakness of the electric field are determined by how much the electric flux line projected from the gate 5 of the electric field converge on the protruding portion of the cathode 6. As a result of the above investigation, it was found that the electric field to be formed at the point A or the point C in the cathode 6 becomes larger, as T5 which is a width of the gate 5 is wider than T4 which is a width of the cathode 6. Desirable sizes are those which satisfy T5/T4>approximately 1.5, for instance. When a plurality of the cathodes 6 are provided with respect to the gate 5, which will be described later, a distance between each of cathodes can be at least twice or more than that of T2 from the viewpoint of the convergence of an electric field, and the distance can be larger than T3.

In the above, it was described that electric fields in the maximum electric field points A and C were different from an electric field in a point B other than those points. As a result of a detailed investigation for the difference, it is found that the difference changes according to a distance between a gate 5 and a cathode 6 (size of gap 8). This distance dependency will now be described below with reference to FIG. 7A to FIG. 9.

FIGS. 7A and 7B and FIGS. 8A and 8B illustrate cases where heights (h) of the protruding portion of a cathode 6, which has been formed in a recess portion 7, are different from each other. Here, h1 is smaller than h2, and accordingly d1 is larger than d2. Here, distances d1 and d2 between the cathode 6 and the gate 5 are defined as the shortest distance between the maximum electric field point formed in the protruding portion of the cathode 6 and the gate 5. The maximum electric field point of the cathode 6 is arranged so as to have a distance expressed by δ from the edge of the gate 5 in a direction parallel to the surface of the substrate.

Figure 6:
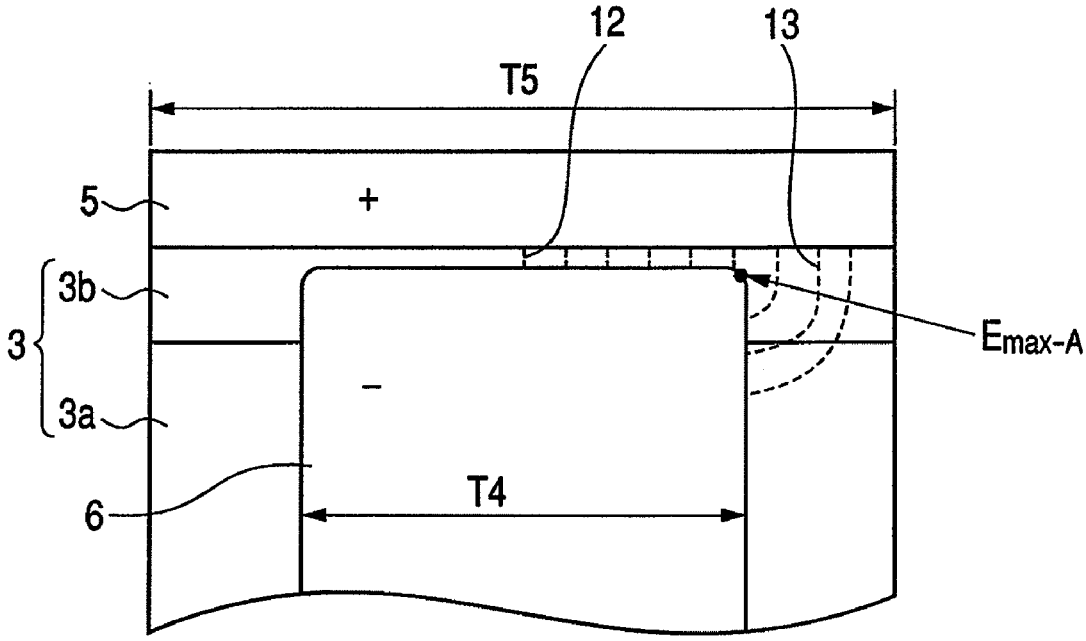
FIG. 6 is a view illustrating electric flux lines appearing when a protruding portion is high in an electron-emitting device according to the present invention.
Figure 7A:
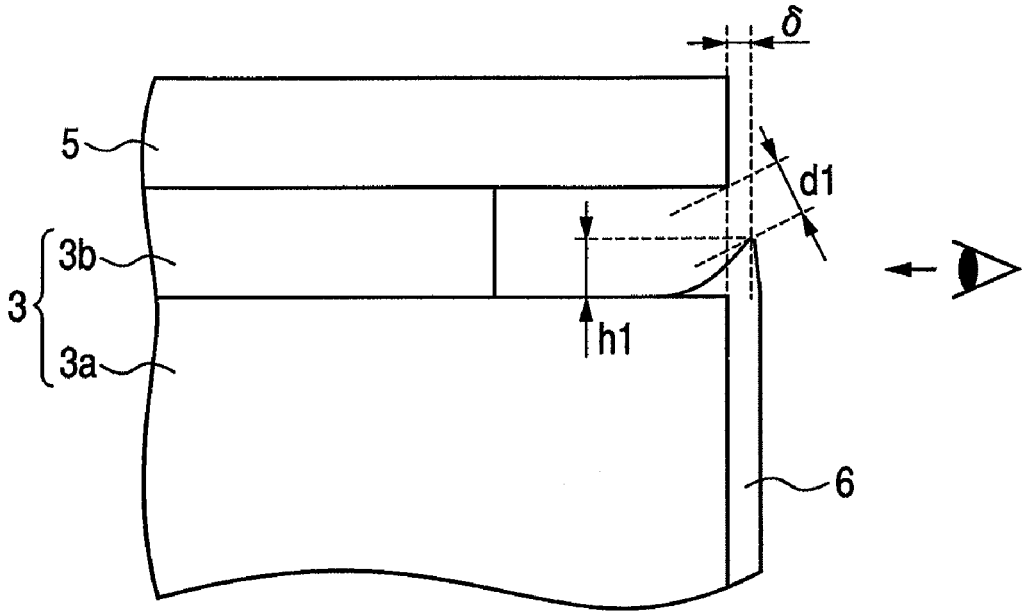
FIGS. 7A and 7B are views illustrating a relationship between a distance between a gate and a cathode and the point of the maximum electric field at a protruding portion of the cathode, in an electron-emitting device according to the present invention.
Figure 7B:
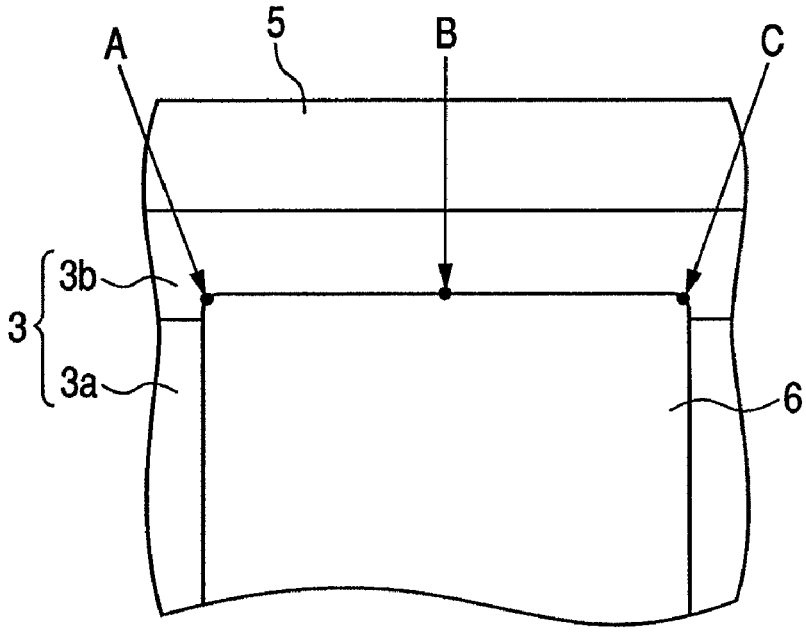
Figure 8A:
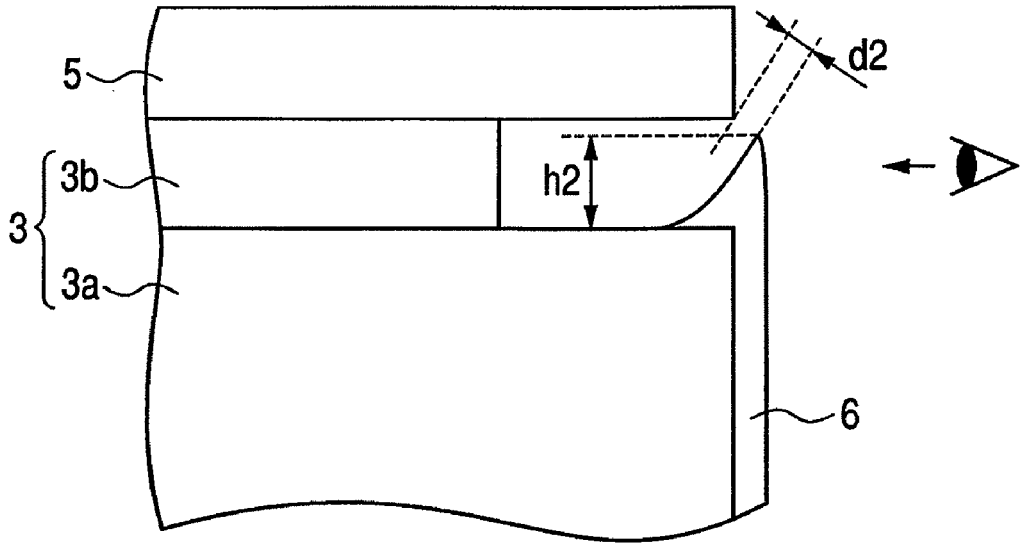
FIGS. 8A and 8B are views illustrating a relationship between a distance between a gate and a cathode and the point of the maximum electric field at a protruding portion of the cathode, in an electron-emitting device according to the present invention.
Figure 8B:
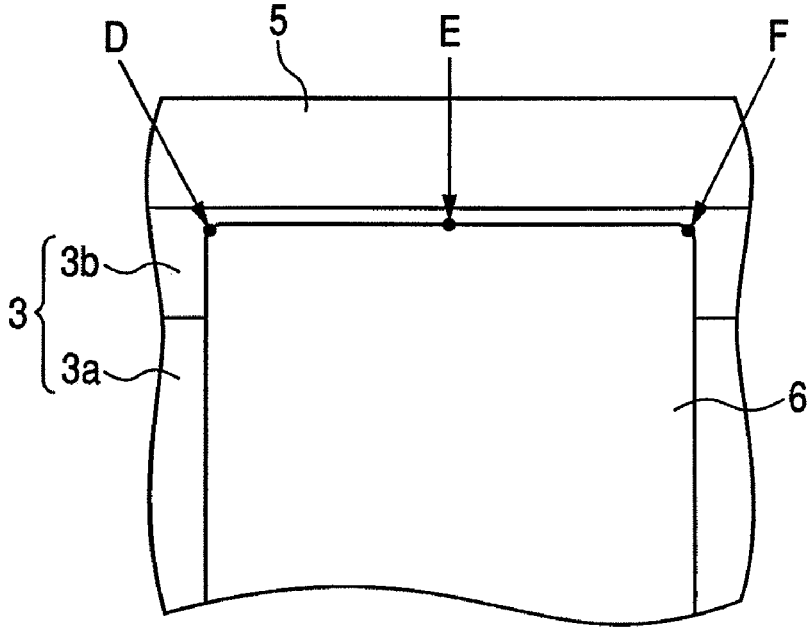

The electric flux lines of the cathode 6 in FIG. 7B and FIG. 8B are formed so as to correspond to those in FIG. 5A and FIG. 6, respectively. Specifically, when the cathode 6 extremely approaches the gate 5, the electric flux lines 13 do not converge on the end part in the width direction of the protruding portion of the cathode 6, as is illustrated in the electric flux line 13 in FIG. 6. In other words, it indicates that the density of the electric flux line to be formed by a distance d2 between the cathode 6 and the gate 5 is equal to or larger than the density of the electric flux line which converge on the protruding portion, and accordingly that an electric field to be formed is controlled by the distance d2 rather than the shape. In other words, it has been found that a convergence effect of the electric field due to the shape, which was described above with reference to FIGS. 4 and 5, does not appear depending on the size of d2.

Figure 9:
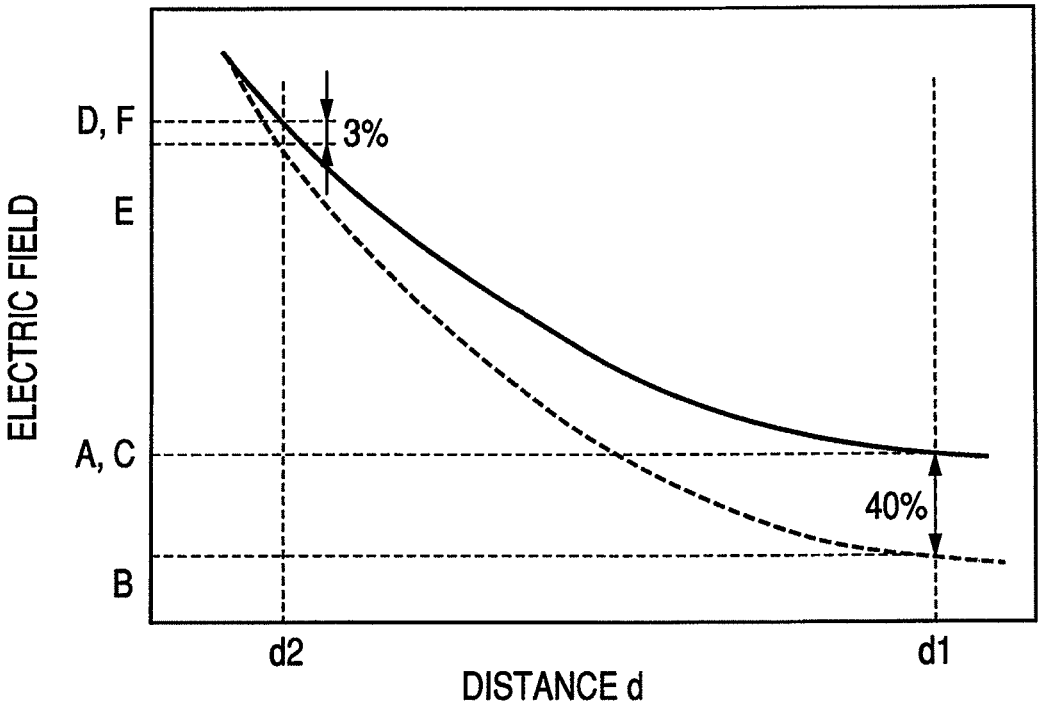
FIG. 9 is a view illustrating a relationship between a distance between a gate and a cathode and the point of the maximum electric field at a protruding portion of the cathode, in an electron-emitting device according to the present invention.

This relationship is shown in a graph of FIG. 9. In the calculation, such a structure as to show an effect of the present invention was employed, specifically, the values of T1 of 20 nm, T2 of 20 nm, T3 of 500 nm, T4 of 4,000 nm, T5 of 8,000 nm and (h) of 5 nm (see FIGS. 4A and 4B) in FIG. 3 were employed.

In FIG. 9, a horizontal axis represents a distance (d) (d1 of FIG. 7A and d2 of FIG. 8B) between a cathode 6 and a gate 5, and a vertical axis represents an electric field in each position of a protruding portion of the cathode 6. In FIG. 9, a solid line shows a state in which an electric field to be formed on both end parts (A, C, D and F in FIGS. 7A and 7B and FIGS. 8A and 8B) in a width direction of a protruding portion of the cathode 6 varies along with the distance (d). A broken line shows a state in which an electric field in the center (B and E in FIGS. 7A and 7B and FIGS. 8A and 8B) in the width direction of the protruding portion of the cathode 6 varies along with the distance (d). By the way, it is known in this calculation that the relationship is not relevant to physical properties of a material, for instance, a work function or resistivity (though strictly, difference of work function between gate material and cathode material is slightly involved in electric field), and is simply determined by the shapes of and a distance between two electrode layers.

FIG. 9 shows that electric fields to be formed in a point A and a point C in FIG. 3 become less different from an electric field to be formed in a point B in FIG. 3, as the distance (d) becomes smaller. Typical values in this graph are shown in Table 1.

TABLE 1

| d (nm) | $E_{max}$ (V/cm) | Ec (V/cm) |
|---|---|---|
| 3 | $8.63 \times 10^7$ | $8.37 \times 10^7$ |
| 10 | $3.25 \times 10^7$ | $2.76 \times 10^7$ |
| 15 | $2.36 \times 10^7$ | $1.57 \times 10^7$ |

As is clear from the numeric values in Table 1, it was found that when the distance (d) was approximately 3 nm, a difference of electric-field strengths between the points A and C and the point B (difference of electric-field strengths between points D and F and point E in FIG. 8B) was only approximately 3%, but the difference of the electric-field strengths could be set at 10% or more by expanding the distance (d).

An electron-emitting position in the preferred embodiment when a difference between the strengths of electric fields is formed in a protruding portion of the above described one cathode 6 will now be described below.

When a voltage is applied in between the cathode 6 and the gate 5 under the condition of keeping a distance (d) between the cathode 6 and the gate 5 at an appropriate distance as is illustrated in FIGS. 5A to 5C, the electric-field strengths differ according to the positions in the same cathode 6. When an electron emission is caused by an electric field expressed by a Fowler-Nordheim equation, more electrons can be emitted from an end part in the width direction of the protruding portion of the cathode 6 as is shown by 10 in FIG. 3 illustratively, due to the difference of the caused electric field. On the other hand, a slight amount of electrons can be emitted from the center in the width direction as is shown by 11 in FIG. 3. As a result, the electron-emitting point could be fixed on the end part in the width direction of the protruding portion.

The distance (d) and an amount of emitted electrons were examined in detail by using FEEM (which is a method of optically measuring an amount of emitted electrons with the use of commercial PEEM (photoelectron microscope) device while enlarging an electron-emitting portion with the use of electron lens). As a result, the electron-emitting portion could be clearly formed in the end part in the width direction of the protruding portion by setting the distance (d) at approximately 6 nm or more. As a result of the analysis, it was found that a difference between amounts of electrons emitted from the center and from the end part could be one order of magnitude or more. However, when the electron-emitting portion is formed in a shorter distance (d) less than 6 nm, the electron-emitting portion is formed in the vicinity of the center as well. Furthermore, when the electron-emitting portion is formed at a point having a distance (d) of approximately 3 nm, the electron-emitting points were observed at random in the width direction of the protruding portion, and a position of emitting electrons could not be clearly discriminated.

From these experimental results, a lower limit of the distance (d) as a preferred condition in which the electron-emitting point can be formed in the end part in the width direction of the protruding portion needs to be approximately 6 nm or more, and can be 10 nm or more.

As was described above, it was found that the following requirements were necessary in order to stably converge an electric field on the end part in the width direction of the protruding portion of the cathode 6.

(1) A width of the gate 5 is wider than that of the cathode 6.

(2) The cathode 6 has a protruding portion which protrudes in a recess portion 7, and the head of the protruding portion is formed in a side which is closer to the gate 5 than the edge of the recess portion 7.

As a result, in the preferred embodiment, it is possible to achieve, with a simple structure, the position control of the electron-emitting points in the electron-emitting device. In addition, it is confirmed as will be described later that an electron-emitting device having a structure in which the gate 5 has a humped portion thereon shows an effect of enhancing the efficiency even when the distance (d) is 6 nm or less. The detail will be described later.

Next, a trajectory of an electron which has been emitted in the above described manner will now be described below.

(Description of Scattering in Electron Emission)

In FIG. 3, the electrons which have been emitted from a head of a protruding portion of a cathode 6 toward an opposing gate 5 are isotropically scattered on the tip part of the gate 5, and some electrons are taken out to the outside without causing collision. Many of electrons are scattered in a side face 5*b* of the gate 5, and some electrons are scattered in the bottom face 5*a* of the gate 5 as well. It affects efficiency on which face the electrons are scattered. It is possible to enhance electron emission efficiency by separating a position of the protruding portion from the gate 5 as far as possible, and thereby reducing the scattering of the electrons in the bottom face 5*a* of the gate 5.

As was described above, many of electrons which have been scattered in the gate 5 repeat elastic scattering (multiple scattering) several times in the gate 5, but cannot scatter in the upper side of the gate 5, and jump out to the anode side.

As was described above, it is apparent that such a structure as to reduce scattering frequency (falling frequency) of the electron in the gate 5 can realize an enhancement of the efficiency.

Figure 10:
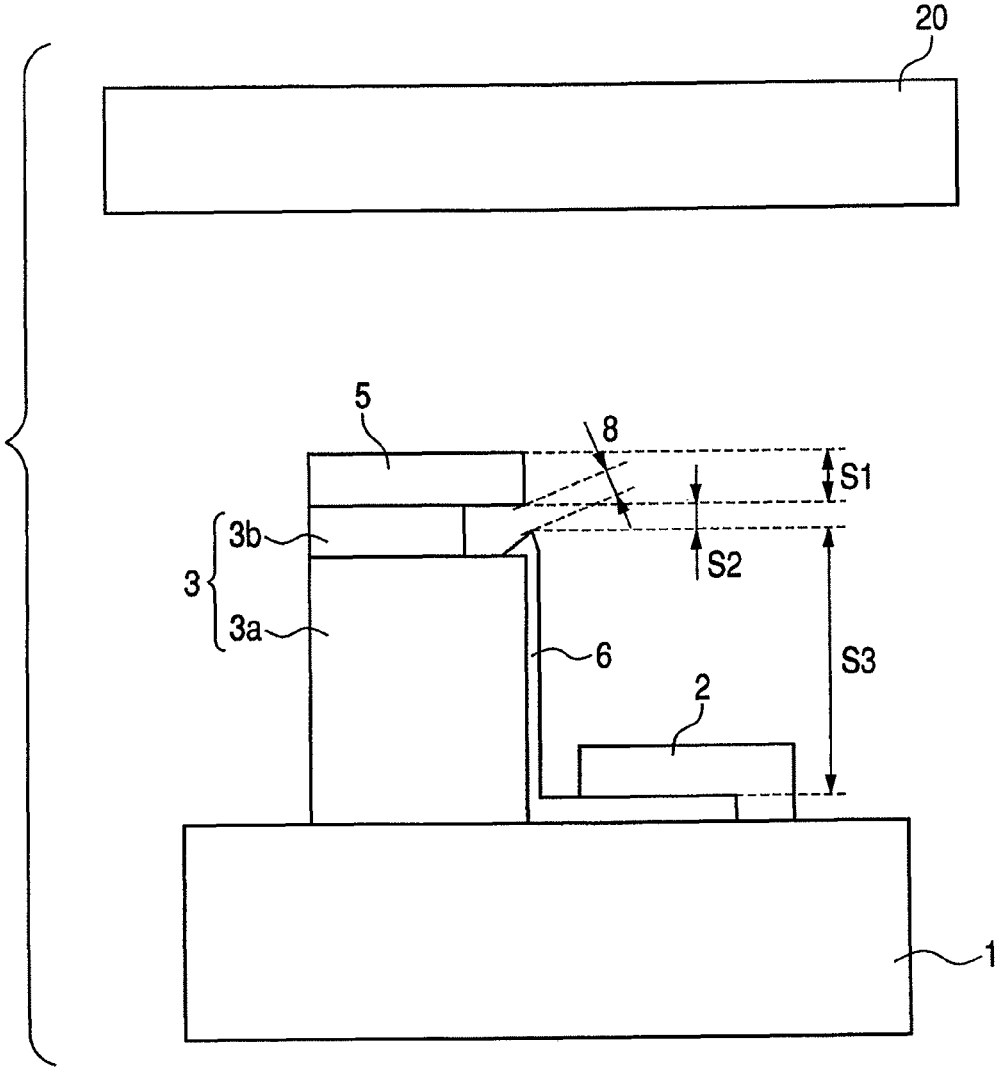
FIG. 10 is a view for describing a relationship between a frequency of scattering of an emitted electron and a distance between a gate and a cathode, in the present invention.

A scattering frequency and a distance will now be described below with reference to FIG. 10.

The potential of the present device includes a potential in a gate side (high potential) and a potential in a cathode side (low potential) while sandwiching a gap 8 in between a cathode 6 and a gate 5. In the figure, S1, S2 and S3 represent each of region lengths which are determined by each of the potentials in the device, and are different from the simple thickness of an electrode, the thickness of an insulating layer and the like.

When a voltage Vf is applied in between the cathode 6 and the gate 5 of the device according to the present invention, electrons are emitted from the head of the protruding portion of the cathode 6 toward the opposing gate 5 having a high potential, and the electrons are isotropically scattered on the tip part of the gate 5. Many of electrons emitted from the tip part of the gate 5 repeat elastic scattering once to several times in the gate 5, similarly in a conventional device.

In the present invention, a space potential distribution formed by a driving voltage in between an anode 20 and the device is different from that in a conventional one, so that some of emitted electrons reach the upper part of the gate 5 without being scattered in the gate 5 and directly reach the anode 20. The electron which has not been scattered in the gate 5 in this way is important for the improvement of electron emission efficiency.

In the case of the present invention, the electron emission efficiency is mainly determined by a distance S1. Furthermore, an electron which has not been scattered exists when S1 is set at a length shorter than the maximum flight distance in a first scattering.

A scattering behavior in the present structure was examined in detail. As a result, it became apparent that a region which can enhance the electron emission efficiency exists as a function of a work function ϕwk of a material used for the gate 5 and a driving voltage Vf, and as a function of distances S1 and S3, that is to say, due to an effect of a shape in the vicinity of electron-emitting portion.

As a result of an analytic investigation, the following formula (1) concerning $S1_{max}$ (T1 in FIG. 3) has been derived:

$$S1_{max}=A\times\exp\{B\times(V-\phi wk)/Vf\} \quad (1)$$

A=−0.78+0.87×log (S3)

B=8.7, wherein S1 and S3 represent a distance (nm), ϕwk represents a value of a work function of the gate 5 (where the unit is eV), Vf represents a driving voltage (V), (A) represents a function of S3 and (B) represents a constant.

It was found that S1 is the important parameter relating to scattering for the electron emission efficiency as was described above, and that an effect of remarkably enhancing the efficiency can be obtained by setting S1 in a range of Formula (1).

Here, a feature of a protruding shape in a recess portion 7 and a desirable form thereof will now be described below.

Figure 11A:
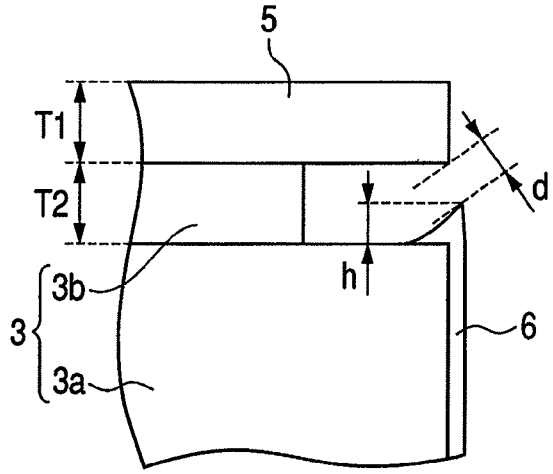
FIGS. 11A, 11B and 11C are views for describing an action of a protruding portion in a cathode, in an electron-emitting device according to the present invention.
Figure 11B:
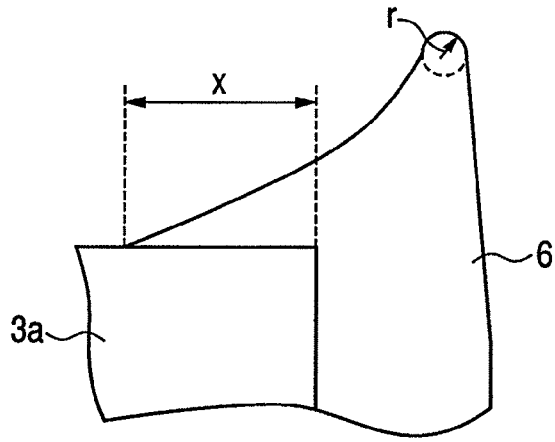

FIG. 11A is an enlarged view in the vicinity of a recess portion 7 of FIG. 1B, and FIG. 11B is a schematic sectional view in which a protruding portion of a cathode 6 is enlarged.

When a tip part of the protruding portion is enlarged, a protruding shape represented by a curvature radius (r) exists on the tip part. The strength of the electric field on the tip part of the protruding portion varies depending on the curvature radius (r). As the curvature radius (r) is smaller, an electric flux line converges more, and consequently a higher electric field can be formed on the tip part of the protruding portion. Accordingly, when the electric field of the tip part of the protruding portion is kept constant, that is to say, when a driving electric field is kept constant, a distance (d) becomes large when the curvature radius (r) is relatively small, and the distance (d) becomes small, when the curvature radius (r) is relatively large. The difference of the distance (d) appears as a difference of scatter frequency, so that a device structure having a smaller curvature radius (r) and a larger distance (d) can show higher electron emission efficiency. The relationship will now be described below with reference to FIG. 11C.

Here, the horizontal axis shows a curvature radius (r) of a tip part of a protruding portion, and a vertical axis shows a distance (d) between a cathode 6 and a gate 5.

Figure 11C:
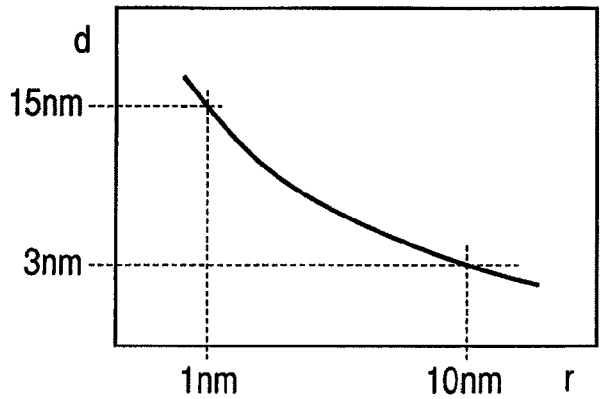

Incidentally, the curve in FIG. 11C is calculated by using the same model as in FIG. 9. FIG. 11C shows a relationship between a curvature radius (r) and a distance (d) to be obtained when an electric field to be obtained at the tip part of the protruding portion is kept constant. This calculation example shows that when the curvature radius (r) is 1 nm, the distance (d) can be set at 15 nm, and that when the curvature radius (r) is 10 nm, the distance (d) is set at 3 nm.

This means, in other words, that when the curvature radius (r) is small, the electron emission efficiency increases due to the shape effect of the tip part of the protruding portion of the cathode 6, and accordingly S1 in the above described Formula (1) can be set at a large value on conditions that the electron emission efficiency is constant. This fact means that the structure of the gate 5 can be made to be strong. Accordingly, such a stable device as to be endurable to a drive for a long period of time can be provided.

By the way, there is a case where the protruding portion of the cathode 6 is formed into such a shape as to enter into the recess portion 7 with a distance (x), as is illustrated in FIG. 11B, though it depends on a manufacturing process. Such a shape depends on a method of forming the cathode 6. When an EB vapor deposition method or the like is employed, not only an angle and a period of time in vapor deposition but also thicknesses shown by T1 and T2 become parameters. On the other hand, a sputter forming method generally shows a large throwing power, so that the shape is difficult to be controlled. For this reason, it is necessary to select a sputter pressure and a gas type and install not only a mechanism for controlling a moving direction but also a special mechanism for depositing particles on a substrate.

A method for manufacturing the above described electron-emitting device according to the present invention will now be described below with reference to FIGS. 14A-A to 14A-C and FIGS. 14B-D to 14B-F A substrate 1 is an insulative substrate for mechanically supporting a device, and is quartz glass, a glass containing a reduced amount of impurities such as Na, soda-lime glass or a silicon substrate. The substrate 1 needs to have functions of not only a high mechanical strength but also resistances to dry etching or wet etching and an alkaline solution such as a developer and an acid solution; and when being used as an integrated product like a display panel, can have a small difference of thermal expansion between itself and a film-forming material or another member to be stacked thereon. The substrate 1 can also be a material which hardly causes the diffusion of an alkali element and the like from the inner part of the glass due to heat treatment.

At first, an insulating layer 73 to be an insulating layer 3*a*, an insulating layer 74 to be an insulating layer 3*b* and an electroconductive layer 75 to be a gate 5 are stacked on the substrate 1, as is illustrated in FIG. 14A-A. The insulating layers 73 and 74 are insulative films made from a material having excellent workability, which is SiN ($Si_xN_y$) or $SiO_2$ for instance; and are formed with a general vacuum film-forming method such as a sputtering method, a CVD method and a vacuum vapor deposition method. Thicknesses of the insulating layers 73 and 74 are each set at a range from 5 nm to 50 μm, and can be selected from a range between 50 nm and 500 nm. However, an amount to be etched of the insulating layer 73 must be set so as to be different from that of an insulating layer 74, because a recess portion 7 needs to be formed after the insulating layer 74 has been stacked on the insulating layer 73. A ratio (selection ratio) of the amount to be etched of the insulating layer 73 and the insulating layer 74 can be 10 or more, and is 50 or more if possible. Specifically, for instance, $Si_xN_y$ can be used for the insulating layer 73, and an insulative material such as SiO2, a PSG film having a high phosphorus concentration or a BSG film having a high boron concentration can be used for the insulating layer 74.

An electroconductive layer 75 is formed with a general vacuum film-forming technology such as a vapor deposition method and a sputtering method. The electroconductive layer 75 can be a material which has high thermal conductivity in addition to electroconductivity and has a high melting point. The material includes, for instance: a metal such as Be, Mg, Ti, Zr, Hf, V, Nb, Ta, Mo, W, Al, Cu, Ni, Cr, Au, Pt, Pd or an alloy material thereof; and a carbide such as TiC, ZrC, HfC, TaC, SiC and WC. The material also includes: a boride such as $HfB_2$, $ZrB_2$, $CeB_6$, $YB_4$ and $GdB_4$; a nitride such as TiN, ZrN, HfN and TaN; a semiconductor such as Si and Ge; an organic polymer material; and further carbon and a carbon compound of dispersed amorphous carbon, graphite, diamond like carbon and diamond. The material for the electroconductive layer 75 is appropriately selected from these materials.

The thickness of the electroconductive layer 75 is set at a range of 5 nm to 500 nm, and can be selected from the range of 50 nm to 500 nm.

Next, after the above layer has been stacked, a resist pattern is formed on the electroconductive layer 75 with a photolithographic technology, and then the electroconductive layer 75, the insulating layer 74 and the insulating layer 73 are sequentially processed with an etching technique, as is illustrated in FIG. 14A-B. Thereby, the gate 5 and an insulating member 3 formed of the insulating layer 3*b* and the insulating layer 3*a* can be obtained.

A method to be generally employed for such an etching process is an RIE (Reactive Ion Etching) which can precisely etch a material by irradiating the material with a plasma that has been converted from an etching gas. A processing gas to be selected at this time is a fluorine-based gas such as $CF_4$, $CHF_3$ and $SF_6$, when a target member to be processed forms a fluoride. When the target member forms a chloride as Si and Al do, a chloride-based gas such as $Cl_2$ and $BCl_3$ is selected. In order to set a selection ratio of the above layers with respect to a resist, to secure the smoothness of a face to be etched, or to increase an etching speed, hydrogen, oxygen, argon gas or the like is added at any time.

Only a side face of the insulating layer 3*b* is partially removed on one side face of the stacked body by using an etching technique, and a recess portion 7 is formed as is illustrated in FIG. 14A-C.

The etching technique can employ a mixture solution of ammonium fluoride and hydrofluoric acid, which is referred to as a buffer hydrofluoric acid (BHF), if the insulating layer 3*b* is a material formed from $SiO_2$, for instance. When the insulating layer 3*b* is a material formed from $Si_xN_y$, the insulating layer 3*b* can be etched with the use of a phosphoric-acid-based hot etching solution.

The depth of the recess portion 7, that is to say, a distance between the side face of the insulating layer 3*b* and the side face of the insulating layer 3*a* and the gate 5 in the recess portion 7 deeply relates to a leakage current occurring after a device has been formed, and the more deeply the recess portion 7 is formed, the smaller the value of the leakage current is. However, when the recess portion 7 is too much deeply formed, a problem of the deformation of the gate 5 occurs, so that the recess portion 7 is formed so as to be approximately 30 nm to 200 nm deep.

Incidentally, the present embodiment showed a form in which the insulating member 3 is a stacked body of the insulating layer 3*a* and the insulating layer 3*b*, but the present invention is not limited to the form. The recess portion 7 may be formed by removing a part of one insulating layer.

Subsequently, a release layer 81 is formed on the surface of the gate 5, as is illustrated in FIG. 14B-D. The release layer is formed for the purpose of separating a cathode material 82 which will deposit on the gate 5 in the next step from the gate 5. For such a purpose, the release layer 81 is formed by forming an oxide film by oxidizing the gate 5 or by bonding a release metal with an electrolytic plating method, for instance.

The cathode material 82 constituting a cathode 6 is deposited on the substrate 1 and the side face of the insulating member 3, as is illustrated in FIG. 14B-E. At this time, the cathode material 82 deposits on the gate 5 as well.

The cathode material 82 may be a material which has electroconductivity and emits an electric field, and generally can be a material which has a high melting point of 2,000° C. or higher, has a work function of 5 eV or less, and hardly forms a chemical reaction layer thereon such as an oxide or can easily remove the reaction layer therefrom. Such materials include, for instance: a metal such as Hf, V, Nb, Ta, Mo, W, Au, Pt and Pd, or an alloy material thereof; a carbide such as TiC, ZrC, HfC, TaC, SiC and WC; and a boride such as $HfB_2$, $ZrB_2$, $CeB_6$, $YB_4$ and $GdB_4$. The materials also include a nitride such as TiN, ZrN, HfN and TaN; and carbon and a carbon compound of dispersed amorphous carbon, graphite, diamond like carbon and diamond.

A method for depositing the cathode material 82 to be employed is a general vacuum film-forming technology such as a vapor deposition method and a sputtering method, and can be an EB vapor deposition method.

As was described above, it is necessary in the present invention to form a cathode by controlling an angle of vapor deposition, a film-forming period of time, a temperature during film formation and a vacuum degree during film formation so that the cathode 6 can form the optimum shape for efficiently taking out electrons.

The cathode material 82 on the gate 5 is removed by removing the release layer 81 with an etching technique, as is illustrated in FIG. 14B-F. In addition, the cathode 6 is formed by patterning the cathode material 82 on the substrate 1 and the side face of the insulating member 3 with photolithography and the like.

Next, an electrode 2 is formed so as to make the cathode 6 electrically conductive (FIG. 1B). This electrode 2 has electroconductivity similarly to the cathode 6, and is formed with a general vacuum film-forming technology such as a vapor deposition method and a sputtering method, and with a photolithographic technology. Materials of the electrode 2 include, for instance: a metal such as Be, Mg, Ti, Zr, Hf, V, Nb, Ta, Mo, W, Al, Cu, Ni, Cr, Au, Pt and Pd, or an alloy material thereof; and a carbide such as TiC, ZrC, HfC, TaC, SiC and WC. The materials also include: a boride such as $HfB_2$, $ZrB_2$, $CeB_6$, $YB_4$ and $GdB_4$; a nitride such as TiN, ZrN and HfN; a semiconductor such as Si and Ge; and an organic polymer material. The materials further include carbon and a carbon compound of dispersed amorphous carbon, graphite, diamond like carbon and diamond. The material is appropriately selected from these materials.

The thickness of the electrode 2 is set in a range of 50 nm to 5 mm, and can be selected from a range of 50 nm to 5 μm.

The electrode 2 and the gate 5 may be made from the same material or different materials, and may be formed with the same forming method or different methods. However, the film thickness of the gate 5 is occasionally set in a thinner range than that of the electrode 2, so that the gate 5 can be formed from a material having lower resistance.

Next, an application form of the above described electron-emitting device will now be described below.

Figure 15A:
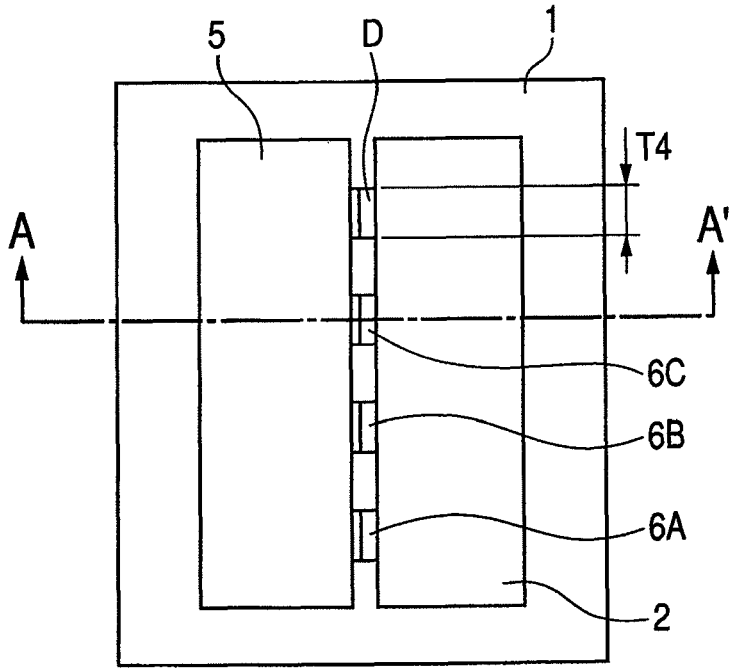
FIGS. 15A, 15B and 15C are views illustrating another structure example of an electron-emitting device according to the present invention.
Figure 15B:
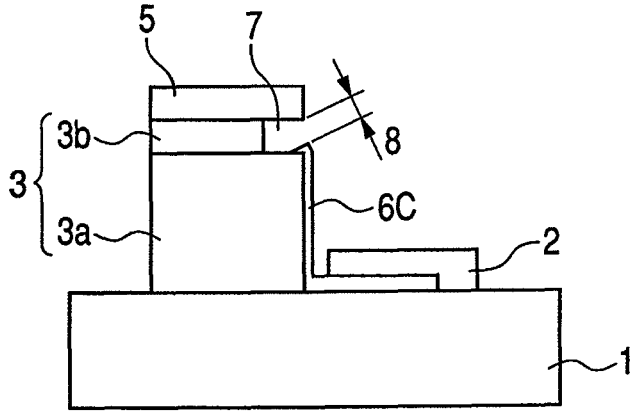
Figure 15C:
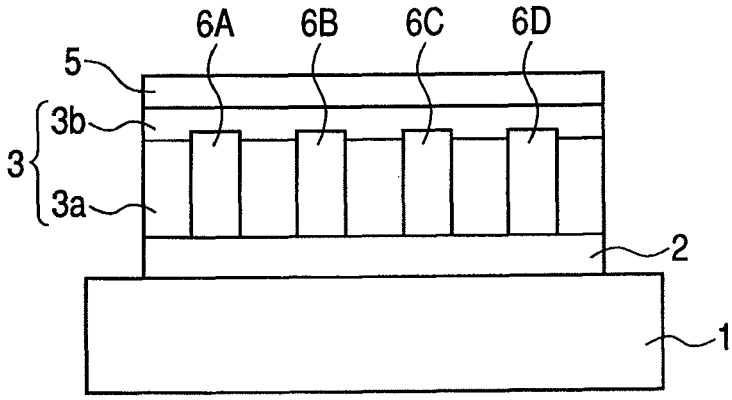

FIGS. 15A to 15C illustrate an example in which a plurality of cathodes 6 are arranged with respect to a gate 5, in an electron-emitting device according to the present invention. FIG. 15A is a schematic plan view which schematically illustrates a structure of an electron-emitting device in the present example. FIG. 15B is a schematic sectional view which is taken along the line A-A' of FIG. 15A. FIG. 15C is a side view of the device, which is viewed from a right side of a page space in FIG. 15A. In the figures, cathodes 6A to 6D are shown. The device has the same structure as the device in FIGS. 1A to 1C, except that the cathode 6 is divided into a plurality of strip shapes and the divided strips are arranged at a predetermined distance from each other.

When a level of convergence of the electric field is controlled by providing a plurality of the cathodes 6A to 6D in this way, an electron preferentially emits from the end parts in the width direction of the protruding portion in each of the cathodes 6A to 6D. As a result, the electron beam source can be provided which has a more uniform shape of an electron beam than that in the case of having provided one cathode 6 as illustrated in FIGS. 1A to 1C {since the end parts of the cathodes to which the electric fields are converged are adjacent to each other (that is, the right end part of the cathode 6A and the left end part of the cathode 6B are adjacent to each other, and, likewise, the right end part of the cathode 6B and the left end part of the cathode 6C are adjacent to each other), the electron beam shape can be controlled based on a physical relationship of the mutually adjacent end parts}. That is to say, the problem is resolved that it is difficult to control the electron beam shape because electron-emitting points are not specified, so that an electron beam source having a uniform shape of the electron beam can be provided only by controlling an array layout of the cathodes 6A to 6D.

A method of manufacturing a device in the present example includes patterning a cathode material 82 so that the number of the cathode becomes plural, in a step of FIG. 14B-F.

Figure 16A:
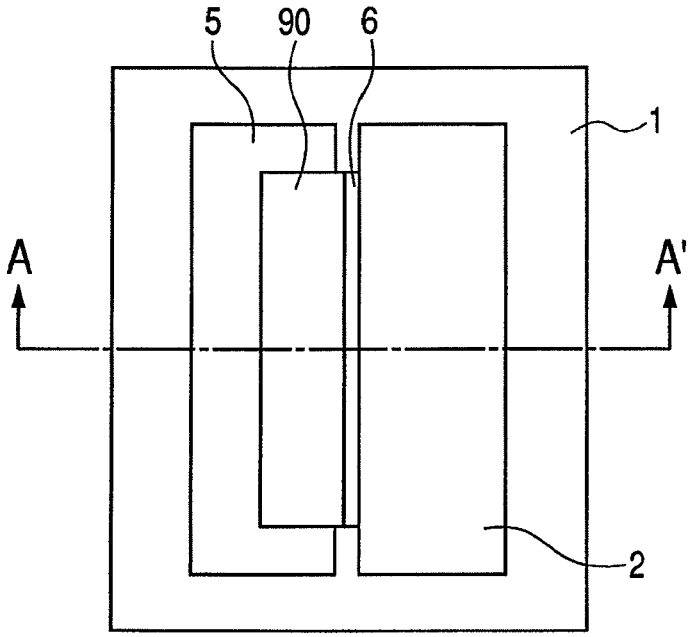
FIGS. 16A, 16B and 16C are views illustrating another structure example of an electron-emitting device according to the present invention.
Figure 16B:
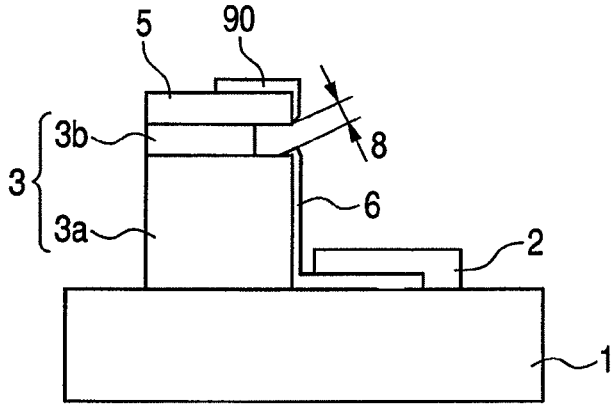
Figure 16C:
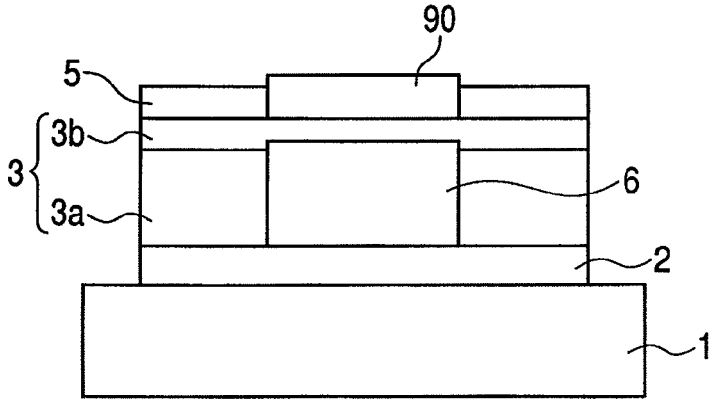
Figure 17:
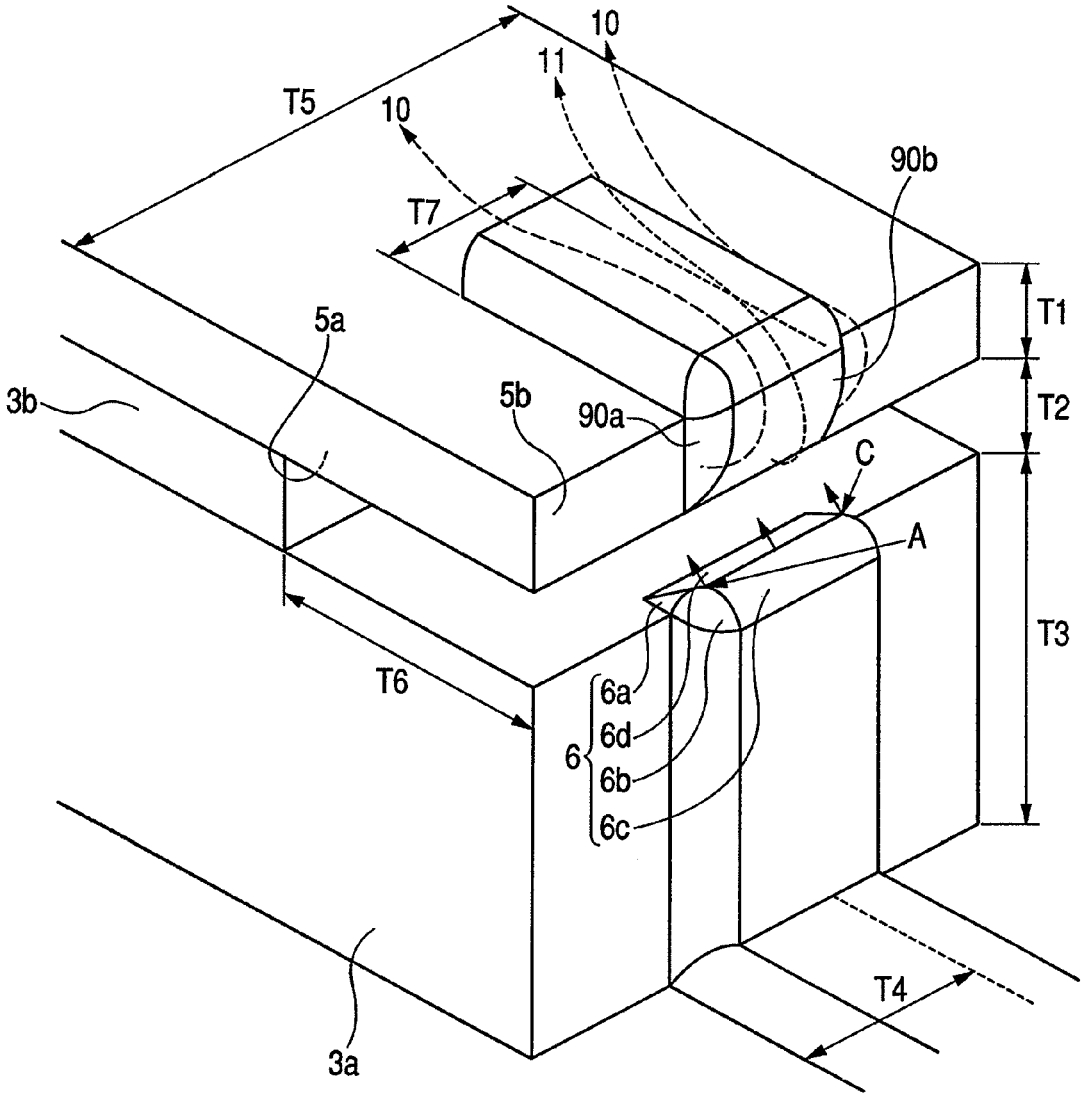
FIG. 17 is a partial enlarged schematic view of an electron-emitting device in FIGS. 16A to 16C.

On the other hand, FIGS. 16A to 16C illustrate an example in which a gate 5 has a humped portion on a part opposing to a cathode 6, in an electron-emitting device according to the present invention. FIG. 16A is a schematic plan view which schematically illustrates a structure of an electron-emitting device in the present example. FIG. 16B is a schematic sectional view which is taken along the line A-A' of FIG. 16A. In addition, FIG. 16C is a side view of a device, which is viewed from a right side of a page space in FIG. 16A. Furthermore, FIG. 17 is an overhead view of the device. In the figure, a humped portion 90 is provided on the gate 5.

Characteristics of a device in the present example will now be briefly described below with reference to FIG. 17. FIG. 17 is an enlarged schematic view of an opposing site of a gate 5 with respect to a cathode 6 in the device in FIGS. 16A to 16C. In the figure, surface elements 90*a* and 90*b* of a humped portion 90 are shown in a portion opposing to the cathode 6. The convergence of the electric field of the cathode 6 was described in FIG. 3, and the description will be omitted here. FIG. 17 is the same figure as FIG. 3, except that a humped portion 90 which humps from the side face of the gate 5 is provided, and that the width of the humped portion 90 is set at T7. The above humped portion 90 is made from an electroconductive material, and is one part of the gate 5, but a part except the humped portion 90 is referred to as the gate 5 for convenience of description in the present example.

In FIG. 17, electrons which have emitted from the cathode 6 collide against the opposing gate 5 and humped portion 90, and some electrons are taken out to the outside without colliding against the gate 5 and the humped portion 90. Many of collided electrons are isotropically scattered on tip parts of surface elements 90*a* and 90*b* in the humped portion 90 again. Many of the scattered electrons are scattered on the surface element 90*a* in the humped portion 90, and some electrons are scattered on the surface element 90*b* as well. The number of escaped electrons at this time was examined from an escape trajectory formed when electrons have been scattered in the scattering surfaces 90*a* and 90*b*, and as a result, it was found that electrons having been scattered on the scattering surface 90*a* showed higher escape probability than electrons having been scattered on the scattering surface 90*b*. It was analytically found that electron emission efficiency increases from several % to several tens % by setting a relationship between the width T4 of the cathode 6 and the width T7 of the humped portion 90 so as to satisfy T4≧T7 (to make T7 equal to or smaller than T4), due to the above result. The efficiency can be enhanced particularly when a difference between T4 and T7 becomes twice or more of T2 which is the height of an insulating layer 3*b*. In addition, it was confirmed that an electron-emitting device which has the humped portion 90 on a gate 6 and satisfies the relation of T4≧T7 shows a high escape probability of an emitted electron and shows an enhanced electron emission efficiency, even when having the above described structure illustrated in FIG. 6 (structure in which electric flux line cannot be confirmed to converge on both ends of protruding portion of cathode).

A method for manufacturing a device in the present example includes skipping a step of preparing a release layer 81 in FIG. 14B-D, and directly depositing a cathode material 82 on the gate 5; and may include patterning the cathode material 82 on a substrate 1 and the side face of an insulating member 3 to form the cathode 6, and simultaneously patterning the cathode material 82 on the gate 5 to form the humped portion 90, in the step (F).

Figure 18A:
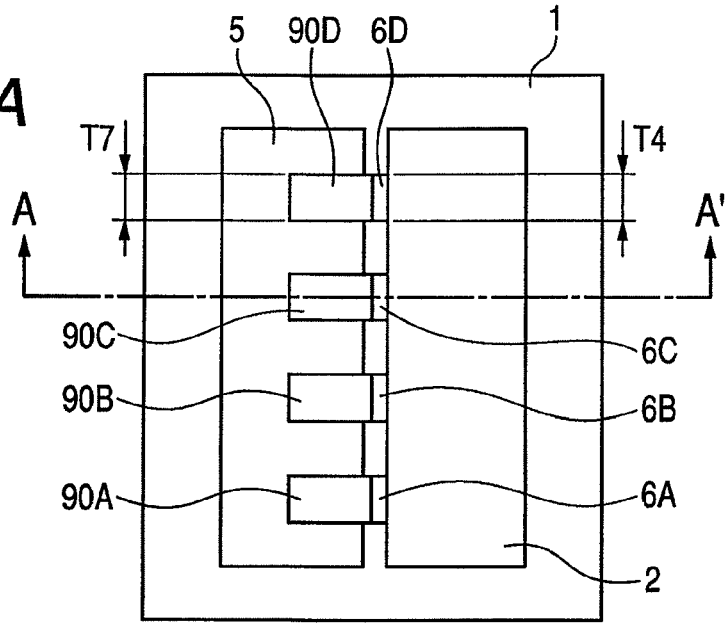
FIGS. 18A, 18B and 18C are views for illustrating a structure in which a device in FIGS. 15A to 15C is combined with a device in FIGS. 16A to 16C.
Figure 18B:
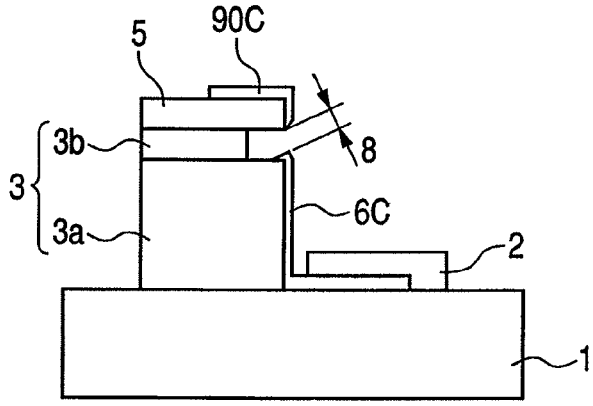
Figure 18C:
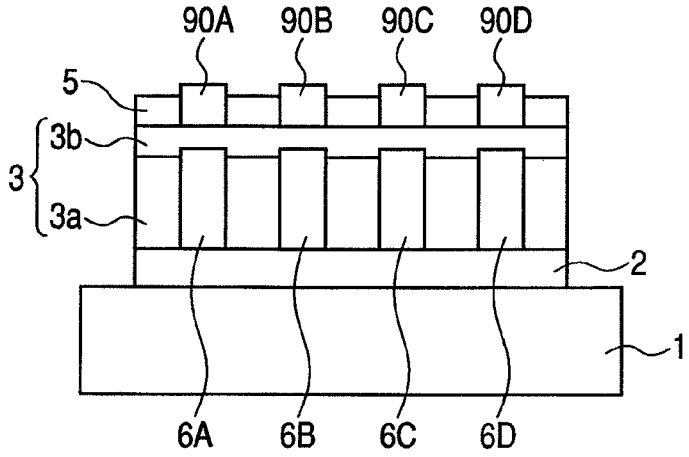

An electron beam apparatus according to the present invention can obtain a synergistic effect by combining a structure in FIGS. 15A to 15C with a structure in FIGS. 16A to 16C. The structure example is illustrated in FIGS. 18A to 18C. FIG. 18A is a schematic plan view which schematically illustrates a structure of an electron-emitting device in the present example. FIG. 18B is a schematic sectional view which is taken along the line A-A' of FIG. 18A. FIG. 18C is a side view of a device, which is viewed from a right side of a page space in FIG. 18A. In the figure, humped portions 90A to 90D are provided on a gate 5, and are arranged so as to correspond to cathodes 6A to 6D respectively. The protruding portion of cathodes 6A to 6D and the humped portions 90A to 90D are formed so that the respective widths T4 and widths T7 satisfy T4≧T7, as was described above.

The device in the present example also can preferentially emit, by controlling a level of convergence of the electric field, electrons from the end parts in the width direction of the protruding portions in each of the cathodes 6A to 6D similarly to the device in FIGS. 15A to 15C, so that an electron beam source providing a uniform electron beam shape can be provided. Furthermore, it is possible to form an electron beam source having higher electron emission efficiency, by providing the humped portions 90A to 90D on the gate 5, and setting the width T7 so as to be smaller than T4 of the protruding portion in the cathodes 6A to 6D.

Figure 19:
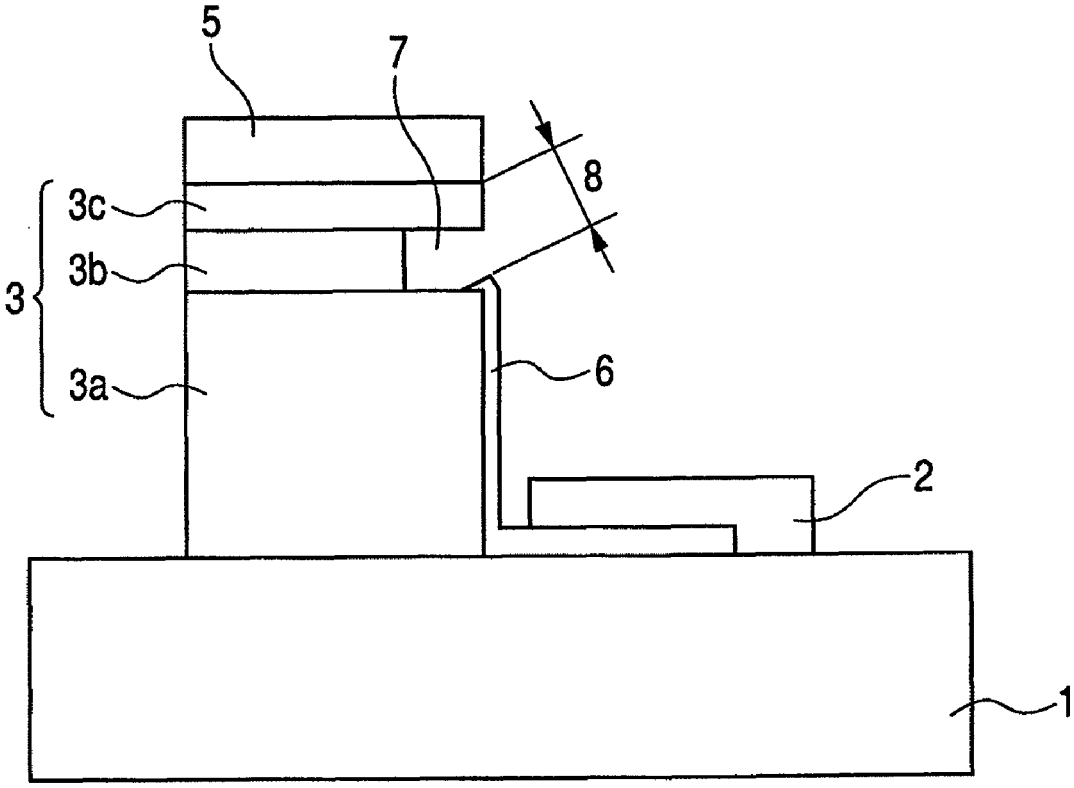
FIG. 19 is a view which schematically illustrates a structure of an electron-emitting device in another embodiment of an electron beam apparatus according to the present invention.

In the above description on the electron-emitting device according to the present invention, an embodiment was shown in which an insulating member 3 is formed of insulating layers 3*a* and 3*b*, and the lower face of the gate 5 is exposed to a recess portion 7. In the present invention, an embodiment can be also applied in which a side of the gate 5 opposing to the protruding portion of the cathode 6 (surface exposed to recess portion 7 in the present example) is covered with an insulating layer 3*c*, as is illustrated in FIG. 19. In the device in FIGS. 1A to 1C, an electron to collide against the bottom face 5*a* of the gate 5 among electrons emitted from the cathode 6 does not reach an anode 20, but becomes a factor of reducing the efficiency (above described If component). However, a structure having the lower surface of the gate 5 covered with the insulating layer 3*c* as illustrated in FIG. 19 can reduce the If, and accordingly enhances the electron emission efficiency. The insulating layer 3*c* which covers the lower surface of the gate 5 can employ, for instance, an SiN film having a film-thickness of approximately 20 nm, and it is confirmed that such a structure can sufficiently show an effect of enhancing the efficiency.

In the structure in FIG. 19, an insulating member 3 forms a stacked body of insulating layers 3*a*, 3*b* and 3*c*, but it may be allowed to form a recess portion 7 by removing one part of one insulating layer.

An electron beam apparatus according to the present invention can combine structures in FIGS. 15A to 15C, FIGS. 16A to 16C and FIGS. 18A to 18C with a structure in FIG. 19. The condition in each structure is similarly set, and the electron beam apparatus shows a similar working effect.

An image display apparatus having an electron source which is obtained by arranging a plurality of electron-emitting devices according to the present invention will now be described below with reference to FIG. 12A to FIG. 12C.

Figure 12A:
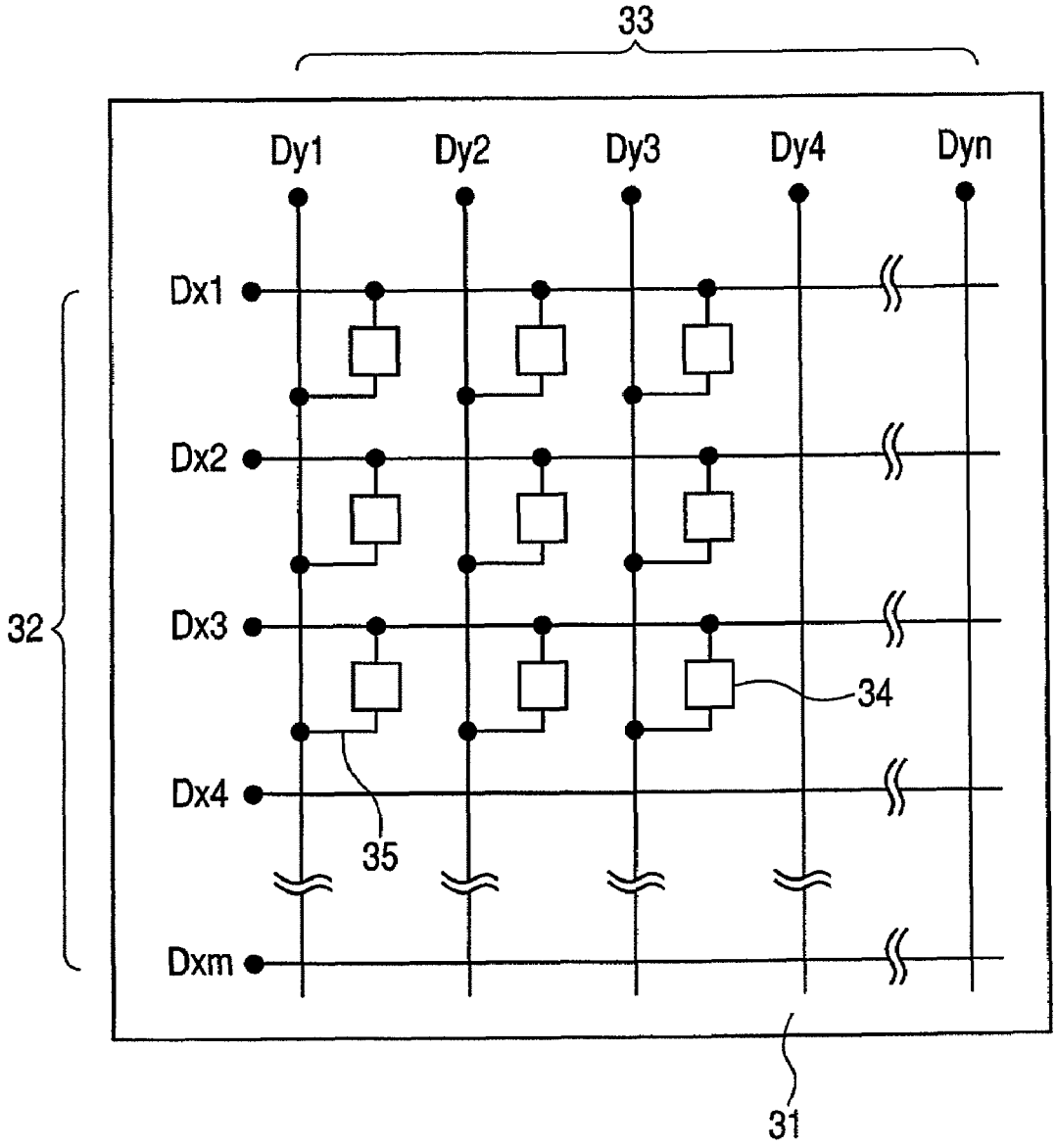
FIG. 12A is a schematic plan view of one example of an electron source provided with a plurality of electron-emitting devices according to the present invention.

In FIG. 12A, an electron source substrate 31, wires in an X-direction 32 and wires in a Y-direction 33 are shown. The electron source substrate 31 corresponds to a substrate 1 of the previously described electron-emitting device. An electron-emitting device 34 according to the present invention and a wire connection 35 are also shown. The above wires in the X-direction 32 are wires for commonly connecting the above described electrode 2, and the wires in the Y-direction 33 are wires for commonly connecting the above described gate 5.

The wires in the X-direction 32 of m lines include Dx1 and Dx2 to Dxm, and can be made by an electroconductive metal or the like, which has been formed by using a vacuum vapor deposition method, a printing method, a sputtering method and the like. A material, a film-thickness and a width of the wires are appropriately designed.

The wires in the Y-direction 33 include n lines of wires Dy1 and Dy2 to Dyn, and are formed similarly to the wires in the X-direction 32. An unshown interlayer insulating layer is provided in between m lines of the wires in the X-direction 32 and n lines of the wires in the Y-direction 33, and electrically separates the wires in both directions from each other (m and n are both positive integer number).

The unshown interlayer insulating layer is made by $SiO_2$ or the like, which has been formed with the use of a vacuum vapor deposition method, a printing method, a sputtering method or the like. The unshown interlayer insulating layer is formed, for instance, on the whole surface or one part of the surface of the electron source substrate 31 having the wires in the X-direction 32 formed thereon to form a desired shape; and the film-thickness, the material and the manufacturing method are appropriately set so as to be resistant particularly to a potential difference in the intersections of the wires in the X-direction 32 and the wires in the Y-direction 33. The wires in the X-direction 32 and the wires in the Y-direction 33 are taken out as external terminals, respectively.

An electrode 2 is electrically connected with a gate 5 (FIGS. 1A to 1C) through m lines of the wires in the X-direction 32, n lines of the wires in the Y-direction 33, and the wire connection 35 made from an electroconductive metal or the like.

A material constituting wires 32 and wires 33, a material constituting the wire connection 35 and a material constituting the electrode 2 and the gate 5 may be made from a partially equal constituent element or a totally equal constituent element, or may be made from different constituent elements respectively.

An unshown scanning-signal-applying unit is connected to the wires in the X-direction 32, and applies a scanning signal for selecting a row of electron-emitting devices 34 which have been arrayed in an X-direction. On the other hand, an unshown modulation-signal-generating unit is connected to the wires in the Y-direction 33, and modulates each column of the electron-emitting devices 34 which have been arrayed in a Y-direction, according to an input signal.

A driving voltage to be applied to each of the electron-emitting devices is supplied in a form of a differential voltage between the scanning signal and the modulation signal to be applied to the device.

The image display apparatus having the above described configuration can select an individual device and independently drive the device by using a simple matrix wiring.

The image display apparatus which has been configured by using an electron source having such a simple matrix arrangement will now be described below with reference to FIG. 12B. FIG. 12B is a schematic view illustrating one example of a display panel of an image display apparatus, in a state in which one part thereof is cut away.

Figure 12B:
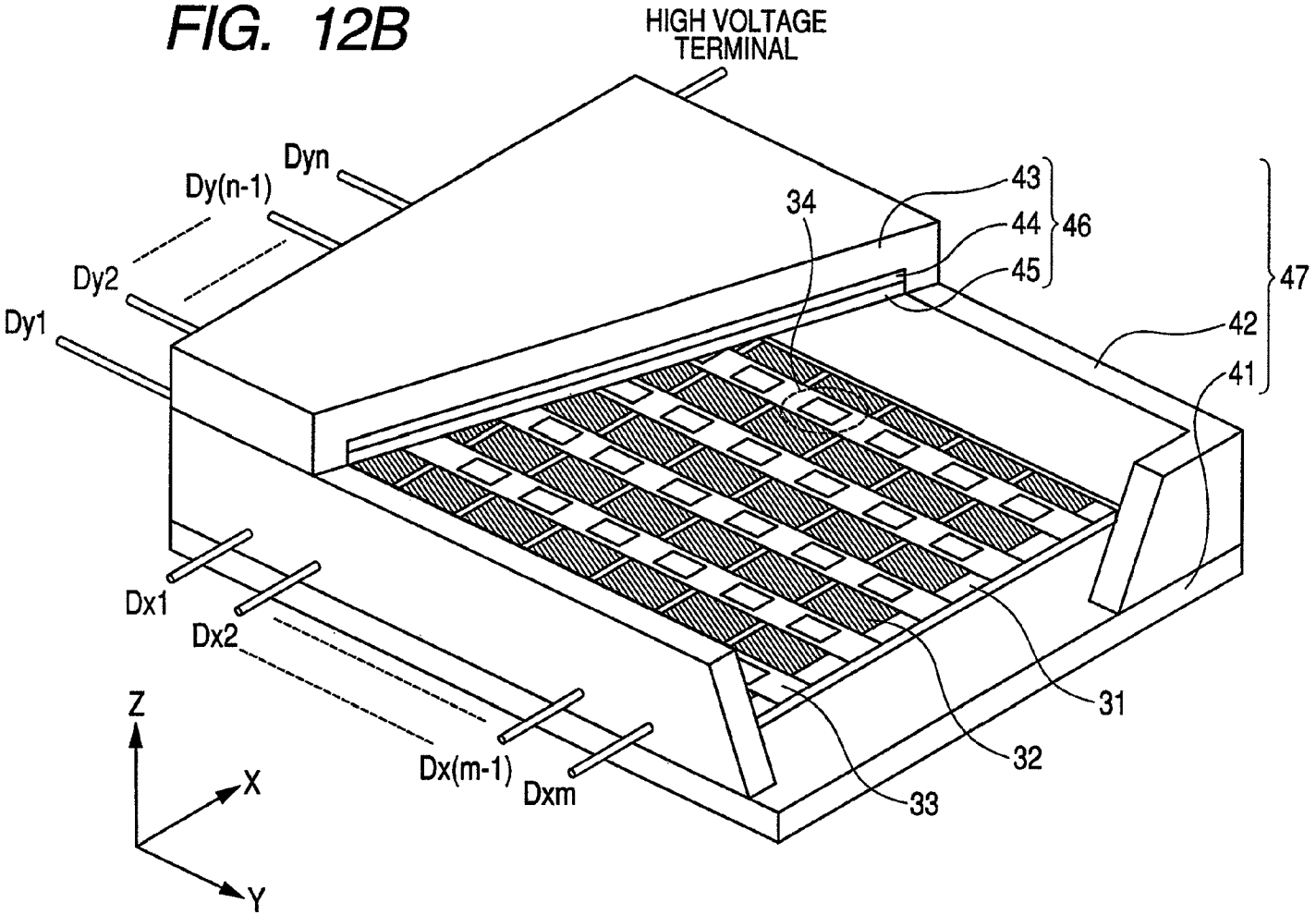
FIG. 12B is a perspective view illustrating a configuration of a display panel which is one example of an image display apparatus that is structured by using an electron beam apparatus according to the present invention.

In FIG. 12B, the same members as in FIG. 12A were designated by the same reference numerals. In addition, a rear plate 41 fixes the electron source substrate 31 thereon, and a face plate 46 has a fluorescent film 44 that is a phosphor working as a light emitting member, a metal-back 45 that is an anode 20 and the like, which are formed on the inner face of a glass substrate 43.

Furthermore, a supporting frame 42 is shown, and an envelope 47 includes the supporting frame 42, and the rear plate 41 and the face plate 46, which are attached to the supporting frame 42 through a frit glass or the like. The envelope is sealed with the frit glass by baking the frit glass in the atmosphere or nitrogen gas in a temperature range of 400 to 500° C. for 10 minutes or longer.

The envelope 47 includes the face plate 46, the supporting frame 42 and the rear plate 41, as was described above. Here, the rear plate 41 is provided mainly so as to reinforce the strength of the electron source substrate 31, so that when the electron source substrate 31 itself has a sufficient strength, an additional rear plate 41 can be eliminated.

Specifically, the envelope 47 may include the face plate 46, the supporting frame 42 and the electron source substrate 31, through directly sealing the supporting frame 42 with the electron source substrate 31. On the other hand, the envelope 47 can have a structure which has a sufficient strength against atmospheric pressure, by arranging an unshown support member referred to as a spacer in between the face plate 46 and the rear plate 41.

In such an image display apparatus, the phosphor is aligned and arranged in the upper part of each of the electron-emitting devices 34, while considering the trajectory of an emitted electron.

FIGS. 12C-A and 12C-B are schematic views illustrating one example of the fluorescent film 44 which is used in an image display apparatus in FIG. 12B. A fluorescent film for a color display may be configured from a black conductive material 51 and a phosphor 52 by arraying the phosphor 52 into a form referred to as a black stripe shown by FIG. 12C-A or a black matrix shown by FIG. 12C-B.

Next, a configuration example of a driving circuit for displaying a television picture based on a television signal of an NTSC system on a display panel which is structured by using an electron source having a simple matrix arrangement will now be described below with reference to FIG. 12D.

Figure 12D:
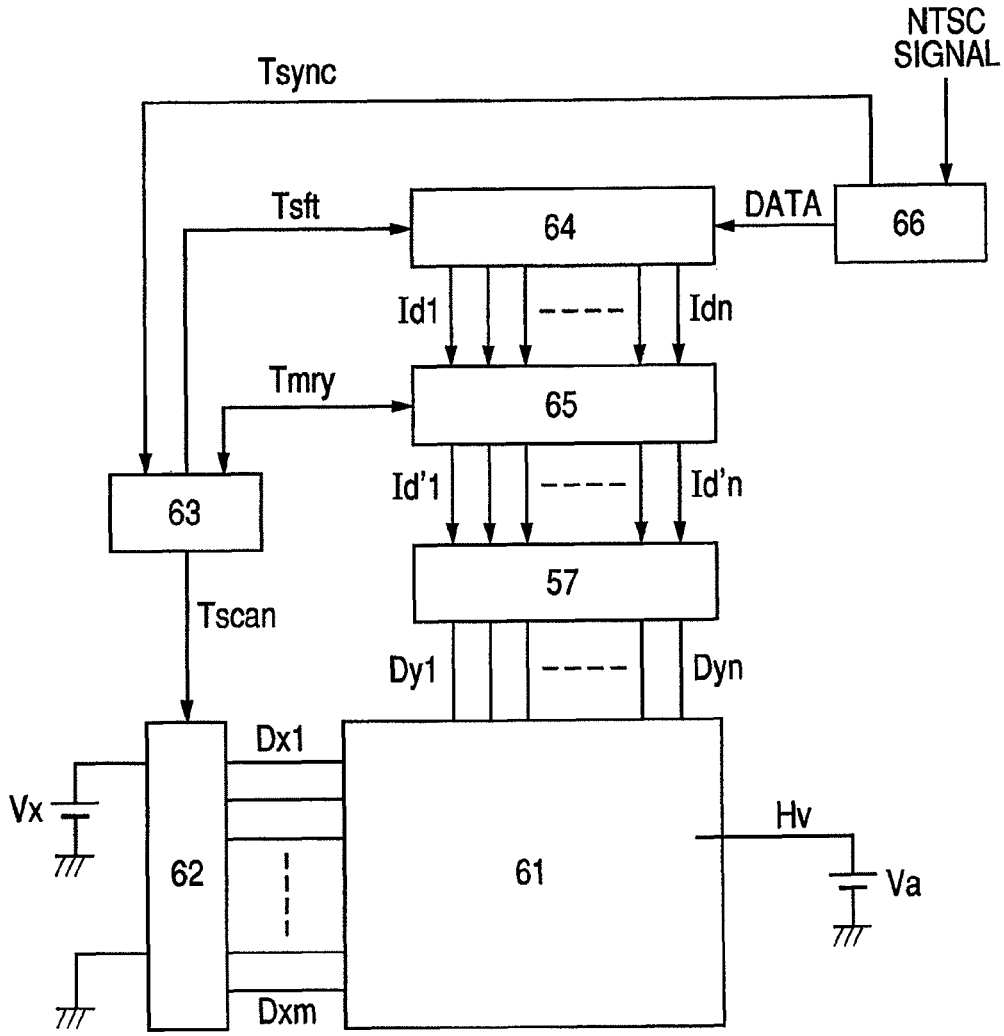
FIG. 12D is a schematic plan view illustrating a configuration example of a driving circuit for displaying a television picture on a display panel in FIG. 12B.

In FIG. 12D, an image display panel 61, a scanning circuit 62, a control circuit 63 and a shift register 64 are shown. A line memory 65, a synchronization signal separation circuit 66, a modulation signal generator 67 and direct-current voltage sources Vx and Va are also shown.

The display panel 61 is connected to an external electric circuit through terminals Dx1 to Dxm, terminals Dy1 to Dyn and a high-voltage terminal Hv. A scanning signal is applied to the terminals Dx1 to Dxm so as to drive electron sources which are provided in a display panel, that is to say, a group of electron-emitting devices which are arranged into a matrix form of m rows and n columns through wires, sequentially by one row (N devices). On the other hand, a modulation signal is applied to terminals Dy1 to Dyn so as to control an output electron beam of each device in one row of electron-emitting devices, which has been selected by the scanning signal.

A direct-current voltage source Va supplies the direct-current voltage, for instance, of 10 [kV] to a high pressure terminal Hv, which is an accelerating voltage for imparting sufficient energy for exciting the phosphor onto an electron beam to be emitted from the electron-emitting device.

As was described above, the emitted and accelerated electrons by the scanning signal, the modulating signal and application of the high voltage to the anode irradiate the phosphor, and realize an image display.

Incidentally, when such a display apparatus is formed by using the electron-emitting device according to the present invention, the structured display apparatus shows a uniform shape of an electron beam, and the provided display apparatus can consequently show adequate display characteristics.

EXEMPLARY EMBODIMENTS

Exemplary Embodiment 1

An electron-emitting device having a structure illustrated in FIGS. 1A to 1C was prepared according to the steps in FIGS. 14A-A to 14A-C and FIGS. 14B-D to 14B-F.

A PD200 was used for a substrate 1, which is low-sodium glass that has been developed for a plasma display, and SiN ($Si_xN_y$) was formed thereon as an insulating layer 73 with a sputtering method so as to have a thickness of 500 nm. Subsequently, an $SiO_2$ layer having a thickness of 30 nm was formed as an insulating layer 74 through a sputtering method. A TaN film having a thickness of 30 nm was stacked on the insulating layer 74 as an electroconductive layer 75 through a sputtering method (FIG. 14A-A).

Subsequently, a resist pattern was formed on the electroconductive layer 75 with a photolithographic technology, and the electroconductive layer 75, the insulating layer 74 and the insulating layer 73 were sequentially processed through a dry etching technique to form a gate 5 and an insulating member 3 which is formed of insulating layers 3*a* and 3*b* (FIG. 14A-B). A processing gas used at this time was a $CF_4$-based gas, because a material which forms a fluoride was selected for the insulating layers 73 and 74 and the electroconductive layer 75. As a result of subjecting the layers to an RIE process with the use of the gas, the insulating layers 3*a* and 3*b* and the gate 5 after having been etched were formed so as to have angles of approximately 80 degrees with respect to a horizontal plane of the substrate 1. The width T5 of the gate 5 was set at 100 μm.

A recess portion 7 was formed in the insulating member 3 (FIG. 14A-C), by peeling the resist and etching the side face of the insulating layer 3*b* so as to form the recess portion with a depth of approximately 70 nm through an etching technique with the use of BHF (solution of hydrofluoric acid and ammonium fluoride).

A release layer 81 was formed (FIG. 14B-D) by electrolytically depositing Ni on the surface of the gate 5 with an electrolytic plating method.

Molybdenum (Mo) which was a cathode material 82 was deposited on the gate 5, the side face of the insulating member 3 and the surface of the substrate 1. In the present example, an EB vapor deposition method was used as a film-forming method. In the present forming method, the substrate 1 was set at the angle of 60 degrees with respect to a horizontal plane. Thereby, Mo was incident on the upper part of the gate 5 at 60 degrees, and was incident on a slope face of the insulating member 3 after having been subjected to the RIE process, at 40 degrees. Mo was formed so as to have the thickness of 30 nm on the slope face (FIG. 14B-E), by fixing the vapor deposition speed at approximately 12 nm/min during vapor deposition, and precisely controlling the vapor deposition period of time to 2.5 minutes.

After the Mo film was formed, the Mo film on the gate 5 was peeled by removing an Ni release layer 81 which had been deposited on the gate 5 with the use of an etchant containing iodine and potassium iodide.

Subsequently, a resist pattern was formed with a photolithographic technology so that a width T4 (FIG. 3) of the protruding portion on a cathode 6 could be 70 μm. Afterwards, the cathode 6 was formed by processing the Mo film on the substrate 1 and the side face of the insulating layer 3 with a dry etching technique. A processing gas used at this time was a $CF_4$-based gas, because molybdenum employed as the cathode material 82 forms a fluoride.

As a result of having analyzed the cross section with a TEM (transmission-type electron microscope), the shortest distance (d) between the cathode 6 and the gate 5 was 9 nm.

Next, an electrode 2 was formed by depositing Cu on the cathode with a sputtering method so as to have the thickness of 500 nm and patterning the Cu film.

After the device was formed through the above described method, the electron emission characteristics were evaluated by using a structure illustrated in FIG. 2. As a result, an average electron emission current Ie was 1.5 μA at the driving voltage of 26 V, and the obtained electron emission efficiency was 17% by average.

Figure 13:
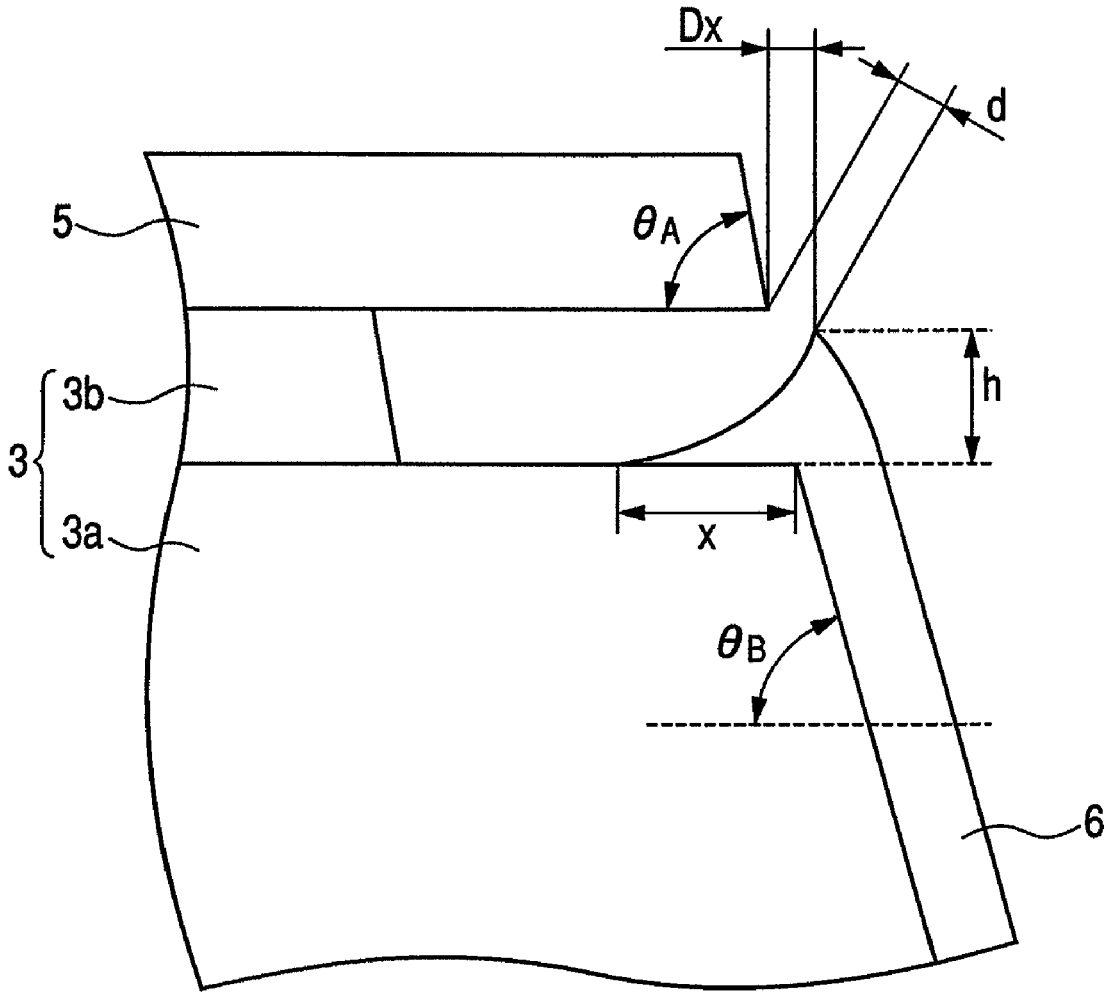
FIG. 13 is a schematic view illustrating a cross sectional shape of a protruding portion in a cathode according to an exemplary embodiment of the present invention.

In addition, as a result of having observed the cross section of the protruding portion of the cathode 6 in the device of the present example with a TEM, the protruding portion showed the cross section having a shape as illustrated in FIG. 13. As a result of having extracted values of each parameter in FIG. 13, the values were $\theta_A$=75 degrees, $\theta_B$=80 degrees, X=35 nm, h=29 nm, Dx=11 nm and d=9 nm.

Exemplary Embodiment 2

The electron-emitting device illustrated in FIGS. 15A to 15C was prepared. The basic preparing method is the same as in Exemplary embodiment 1, so that only the difference from that in Exemplary embodiment 1 will now be described below.

In the step of FIG. 14B-E, an EB vapor deposition method was employed as a method of forming a molybdenum film, and a substrate 1 was set at the angle of 80 degrees with respect to a horizontal plane. Thereby, Mo was incident on the upper part of a gate 5 at 80 degrees, and was incident on a slope face of the insulating member 3 which had been subjected to an RIE processing, at 20 degrees. Mo was formed so as to have the thickness of 20 nm on the slope face, by fixing the vapor deposition speed at approximately 10 nm/min during vapor deposition, and precisely controlling the vapor deposition period of time to 2 minutes.

After the Mo film was formed, the Mo film on the gate 5 was peeled by removing an Ni release layer 81 which had been deposited on the gate 5 with the use of an etchant containing iodine and potassium iodide.

Subsequently, a resist pattern was formed with a photolithographic technology so that a width T4 of the protruding portion on a cathode could be 3 μm and a distance between adjacent cathodes could be 3 μm. Afterwards, the cathodes of 17 lines were formed by processing the Mo film on the substrate 1 and the side face of the insulating member 3 with a dry etching technique. A processing gas used at this time was a $CF_4$-based gas, because molybdenum employed as a cathode material 82 forms a fluoride.

As a result of having analyzed the cross section with a TEM, the shortest distance (d) between the cathode 6 and the gate 5 in FIG. 15B was 8.5 nm.

After an electrode 2 was formed with a similar method to that in Exemplary embodiment 1, the electron emission characteristics were evaluated by using a structure illustrated in FIG. 2. As a result, an average electron emission current Ie was 6.2 μA at the driving voltage of 26 V, and the obtained electron emission efficiency was 17% by average.

When considering from this characteristics, it is assumed that the electron emission current increased by only the number of the cathodes as a result of having prepared a plurality of cathodes.

In addition, an electron-emitting device was prepared in a similar manufacturing process, in which a width of the protruding portion of the cathode and a distance between adjacent cathodes were set at 0.5 μm respectively and the number of the cathodes was increased to 100 lines. Then, the device showed approximately 6 times more amount of emitted electrons.

Exemplary Embodiment 3

The electron-emitting device illustrated in FIGS. 16A to 16C was prepared. The basic preparing method is the same as in Exemplary embodiment 1, so that only the difference from the method in Exemplary embodiment 1 will now be described below.

$SiO_2$ was deposited so as to have the thickness of 40 nm as an insulating layer 74 with a sputtering method, and TaN was deposited so as to have the thickness of 40 nm as an electroconductive layer 75 with a sputtering method.

An insulating layer 73, the insulating layer 74 and the electroconductive layer 75 were dry-etched by an RIE process in a similar way to that in Exemplary embodiment 1. The side face of an insulating member 3 and a gate 5 after having been etched was formed so as to have the angle of 80 degrees with respect to a substrate 1. Subsequently, a recess portion 7 was formed in the insulating member 3, by etching only the side face of an insulating layer 3*b* so as to form the recess portion with a depth of approximately 100 nm through an etching technique with the use of BHF.

In the step of FIG. 14B-E, an EB vapor deposition method was employed as a method of forming a molybdenum film, and the substrate 1 was set at the angle of 60 degrees with respect to the horizontal plane. Thereby, Mo was incident on the upper part of the gate 5 at 60 degrees, and was incident on a slope face of the insulating member 3 after having been subjected to the RIE process, at 40 degrees. Mo was formed so as to have the thickness of 40 nm on the slope face, by fixing the vapor deposition speed at approximately 10 nm/min during vapor deposition, and precisely controlling the vapor deposition period of time of 4 minutes.

Subsequently, a resist pattern was formed with a photolithographic technology so that a width T4 of the protruding portion on a cathode 6 could be 70 μm and a width T7 of the humped portion 90 on the gate 5 could be smaller than T4. Here, T7 was controlled by controlling a taper shape of a resist pattern. Afterwards, the cathode 6 and the humped portion 90 were formed, by processing the Mo film on the substrate 1, the side face of the insulating member 3 and the gate 5 with a dry etching technique. A processing gas used at this time was a $CF_4$-based gas, because molybdenum employed as a cathode material 82 forms a fluoride.

The width T7 of the obtained humped portion 90 was 30 nm smaller than the width T4 of the protruding portion of the cathode 6.

As a result of having analyzed the cross section with a TEM, the shortest distance (d) between the cathode 6 and the gate 5 in FIG. 16B was 15 nm.

Subsequently, after an electrode 2 was formed with a similar method to that in Exemplary embodiment 1, the electron emission characteristics were evaluated by using a structure illustrated in FIG. 2. As a result, an average electron emission current Ie was 1.5 μA at the driving voltage of 35 V, and the obtained electron emission efficiency was 20% by average.

Exemplary Embodiment 4

The electron-emitting device illustrated in FIGS. 18A to 18C was prepared. The basic preparing method is the same as in Exemplary embodiment 3, so that only the difference from the method in Exemplary embodiment 3 will now be described below.

Molybdenum (Mo) which was a cathode material 82 was deposited also on a gate 5, similarly to the method in Exemplary embodiment 3. In the present example, a sputtering vapor deposition method was employed as a film-forming method, and a substrate 1 was set at such an angle as to be horizontal with respect to a sputter target. Argon plasma was generated at a vacuum degree of 0.1 Pa so that sputter particles were incident on the surface of the substrate 1 at a limited angle, and the substrate 1 was set so that the distance between the substrate 1 and the Mo target could be 60 nm or less (mean free path at 0.1 Pa). Furthermore, the Mo film was formed at the vapor deposition speed of 10 nm/min so that the thickness of the Mo film could be 20 nm on the side face of a stacked body.

After the Mo film was formed, a resist pattern was formed with a photolithographic technology so that the width T4 of the protruding portion on a cathode and the width T7 of the humped portion could be 3 μm and that a distance between adjacent cathodes and a distance between adjacent protruding portions could be 3 μm.

Afterwards, the cathodes of 17 lines and the humped portions of 17 lines corresponding to the above cathodes were formed by processing the Mo film with a dry etching technique. A processing gas used at this time was a $CF_4$-based gas, because molybdenum employed as a cathode material 82 forms a fluoride. The width T7 of the obtained humped portion was approximately 10 nm to 30 nm smaller than the width T4 of the protruding portion of the cathode.

As a result of having analyzed the cross section with a TEM, the shortest distance (d) between the cathode and the gate 5 in FIG. 18B was 8.5 nm.

Subsequently, after an electrode 2 was formed with a similar method to that in Exemplary embodiment 1, the electron emission characteristics were evaluated by using a structure illustrated in FIG. 2. As a result, an average electron emission current Ie was 1.8 μA at the driving voltage of 35 V, and the obtained electron emission efficiency was 18% by average.

In addition, an image display apparatus in FIG. 12B was prepared by using the electron-emitting device in the above described Exemplary embodiments 2 and 4. As a result, the display apparatus having an excellent formability of an electron beam could be provided, and consequently the display apparatus showing an adequately displayed image could be realized. In all of the above described exemplary embodiments, a portion of a gate electrode 5 opposing to a recess portion of the insulating member (lower surface of gate electrode) may be covered with an insulating layer. Among electrons emitted from an electron-emitting portion (end part of protruding portion in electroconductive layer), an electron which irradiates the lower surface of the gate does not reach to an anode, and becomes a factor of reducing the efficiency (the above described If component). However, a structure having the lower surface of the gate electrode covered with the insulating layer can reduce If and accordingly enhances the efficiency. An SiN film having a film thickness of approximately 20 nm, for instance, can be used as an insulating layer which covers a portion of the gate electrode 5 opposing to the recess portion of the insulating member (lower surface of gate electrode), and the structure is confirmed to show a sufficient enhancement effect for the efficiency.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-102009, filed Apr. 10, 2008, which is hereby incorporated by reference herein in its entirety.

What is claimed is:

1. An electron-emitting device comprising:

an insulating member;

a cathode disposed on a surface of the insulating member; and a gate disposed on the surface of the insulating member so as to be opposite to an edge of the cathode, wherein the insulating member has a recess on the surface where the edge of the cathode is positioned, the edge of the cathode has a protruding portion protruding from an edge of the recess on the surface of the insulating member toward the gate, and a length of the protruding portion in a direction along the edge of the recess is shorter than a length of a portion of the gate opposite to the protruding portion in the direction along the edge of the recess wherein the gate has a humped portion on a portion opposite to the protruding portion of the cathode, and a length of the portion of the humped portion opposite to the protruding portion in the direction along the edge of the recess is equal to or shorter than the length of the protruding portion.

2. The electron-emitting device according to claim 1, wherein a plurality of protruding portions are disposed in correspondence to the gate along the edge of the recess.

3. An electron beam apparatus comprising:

the electron-emitting device according to claim 1; and an anode disposed in opposite to the edge of the cathode, wherein the gate is disposed between the anode and the edge of the cathode.

4. An image display apparatus comprising:

the electron beam apparatus described in claim 3; and a light emitting member disposed so as to be laminated on the anode.

5. An electron-emitting device comprising:

an insulating member;

a cathode disposed on a surface of the insulating member; and a gate disposed on the surface of the insulating member so as to be opposite to an edge of the cathode, wherein the insulating member has a recess on the surface where the edge of the cathode is positioned, the edge of the cathode has a protruding portion protruding from an edge of the recess on the surface of the insulating member toward the gate, and a length of the protruding portion in a direction along the edge of the recess is shorter than a length of a portion of the gate opposite to the protruding portion in the direction along the edge of the recess wherein the portion of the gate opposite to the recess is covered with an insulating layer.

6. The electron-emitting device according to claim 5, wherein a plurality of protruding portions are disposed in correspondence to the gate along the edge of the recess.

7. An electron beam apparatus comprising:

the electron-emitting device according to claim 5; and an anode disposed in opposite to the edge of the cathode, wherein the gate is disposed between the anode and the edge of the cathode.

8. An image display apparatus comprising:

the electron beam apparatus described in claim 7; and a light emitting member disposed so as to be laminated on the anode.

* * * * *